US012390699B2

(12) United States Patent
Bacon et al.

(10) Patent No.: US 12,390,699 B2
(45) Date of Patent: Aug. 19, 2025

(54) GOLF CLUB HEAD WITH IMPROVED CHARACTERISTIC TIME

(71) Applicant: KARSTEN MANUFACTURING CORPORATION, Phoenix, AZ (US)

(72) Inventors: Cory S. Bacon, Scottsdale, AZ (US); Eric J. Morales, Laveen, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 86 days.

(21) Appl. No.: 18/450,359

(22) Filed: Aug. 15, 2023

(65) Prior Publication Data

US 2024/0050814 A1 Feb. 15, 2024

Related U.S. Application Data

(60) Provisional application No. 63/510,076, filed on Jun. 23, 2023, provisional application No. 63/371,449, filed on Aug. 15, 2022.

(51) Int. Cl.
*A63B 53/04* (2015.01)
*A63B 53/06* (2015.01)

(52) U.S. Cl.
CPC ..... *A63B 53/0412* (2020.08); *A63B 53/0416* (2020.08); *A63B 53/06* (2013.01); *A63B 2053/0491* (2013.01)

(58) Field of Classification Search
CPC ..... A63B 53/0466; A63B 53/0416; A63B 53/0412
See application file for complete search history.

(56) References Cited

U.S. PATENT DOCUMENTS

| | | | | |
|---|---|---|---|---|
| 7,731,603 | B2 | 6/2010 | Beach | |
| 7,744,486 | B2 | 6/2010 | Hou | |
| 7,775,906 | B2 | 8/2010 | Kusumoto | |
| 8,221,261 | B2 | 7/2012 | Curtis | |
| 8,758,161 | B2 | 6/2014 | Golden | |
| 9,987,524 | B2 | 6/2018 | Jertson | |
| 10,195,497 | B1 * | 2/2019 | Greaney | A63B 60/002 |
| 10,843,050 | B2 | 11/2020 | Albertsen | |
| 10,857,435 | B2 | 12/2020 | Schweigert | |
| 11,045,696 | B2 | 6/2021 | Burnett | |
| 11,351,425 | B2 | 6/2022 | Albertsen | |
| 11,364,421 | B2 | 6/2022 | Burnett | |
| 2007/0066420 | A1 | 3/2007 | Imamoto | |
| 2009/0137338 | A1 | 5/2009 | Kajita | |
| 2010/0234126 | A1 | 9/2010 | Cackett | |
| 2017/0128794 | A1 | 5/2017 | Stokke | |
| 2021/0046361 | A1 | 2/2021 | Morales | |
| 2021/0113896 | A1 | 4/2021 | Greensmith | |

* cited by examiner

*Primary Examiner* — Raeann Gorden

(57) ABSTRACT

A driver-type golf club head having a reduced strike face height and a reduced strike face thickness produces a greater golf ball launch speed while maintaining a conforming CT value. In addition, the driver-type golf club head preserves or improves the club head durability, ball flight path optimization, and forgiveness by careful club head mass distribution.

20 Claims, 13 Drawing Sheets

GOLF CLUB HEAD WITH IMPROVED CHARACTERISTIC TIME

CROSS REFERENCE PRIORITIES

This claims the benefit of U.S. Provisional Application No. 63/371,449, filed Aug. 15, 2022, and U.S. Provisional Application No. 63/510,076, filed Jun. 23, 2023, the contents of which are fully incorporated herein by reference.

TECHNICAL FIELD

This disclosure relates generally to golf clubs and, more particularly, relates to driver-type club heads.

BACKGROUND

Golf club designers have desired to maximize the ball speed for driver-type club heads because more ball speed leads to increased carry distance and improved scores. Typically, designers will often look to various mass properties, such as center of gravity location, moment of inertia values, variable face thickness configurations, and other features as means to improve the ball speed of the club head. However, the United States Golf Association (USGA) have implemented limitations which restrict the performance of clubs. One of these limitations is Characteristic Time (CT), which the USGA measures using a CT test. The test measures how long a steel ball swung from a pendulum is in contact with the club face. CT measurement is indicative of the flexibility and energy transfer of the face. Although there is a limitation set out by the USGA to limit the CT of a club head, there is no limit on ball speed.

Throughout the years of golf, designers have been increasing the surface area and size of the strike surface in driver type club heads. A bigger striking surface has been recognized in the art to be advantageous in several ways. The striking surface can be analogous to a drum surface or a trampoline, where a larger surface will create more flexion/displacement of that surface. This holds true for golf club faces as well. As such, designers have tended to create a larger striking surface in order to provide greater face flexion and thus greater ball speeds. Further, it has also been well recognized in the art that the thickness of the striking surface significantly affects the ball speeds. It is common in the art for designers to seek the thinnest possible face within durability tolerances while not exceeding CT limits. As new, higher strength materials are employed in golf club head design, golf club head strike face thickness can be decreased while still preserving club head durability. Such a decrease in strike face thickness would increase the ball speed when struck, but also raise the golf club head CT. The ability to increase ball speed when struck with a given force is constrained by the requirement to limit the golf club head CT. Therefore, there is a need in the art for a driver-type golf club head that can produce higher ball speeds while still maintaining a conforming CT value.

DEFINITIONS

Figure 1:
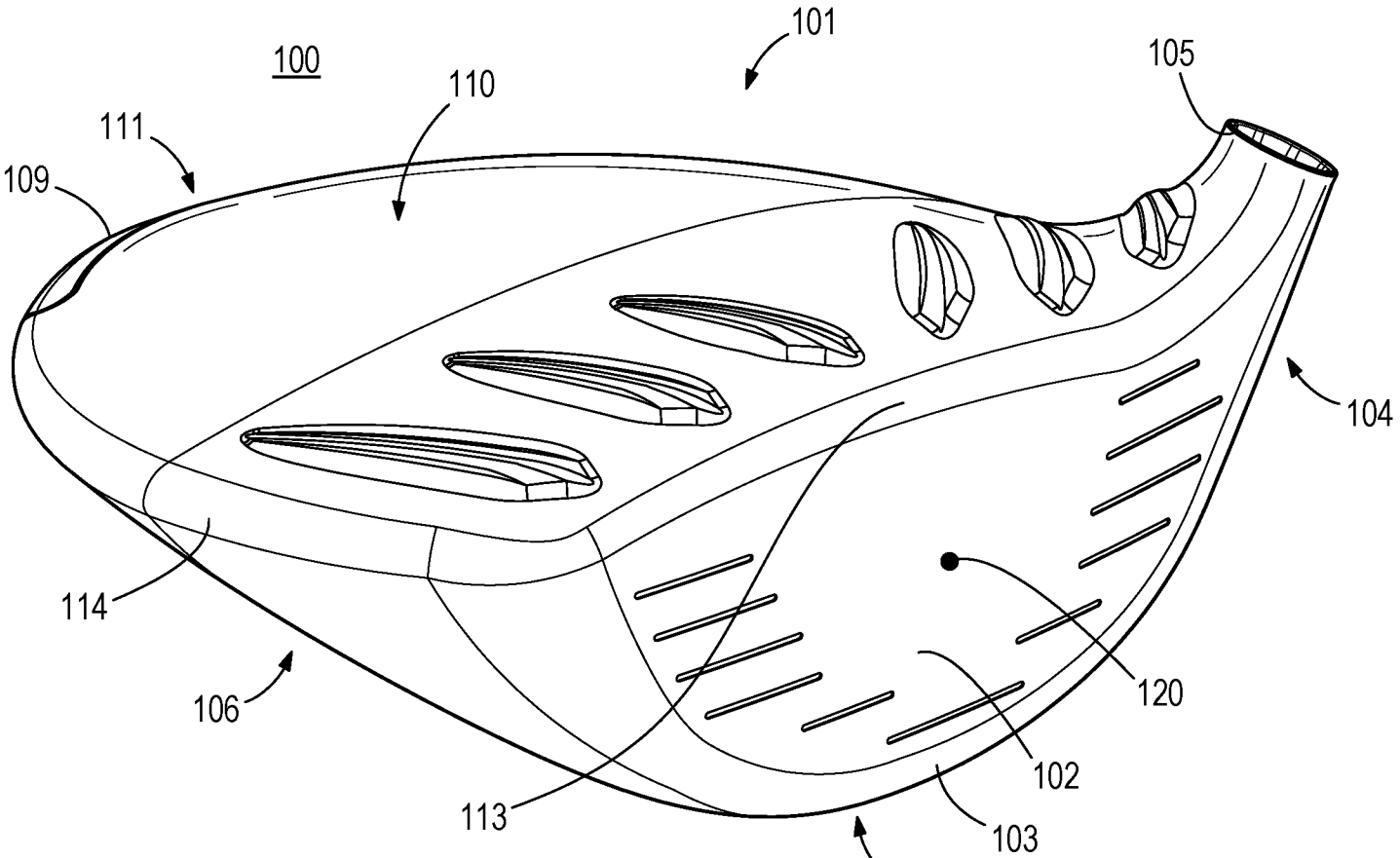
FIG. 1 illustrates a front perspective view of a golf club head according to an embodiment.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

Various embodiments of a golf club are illustrated in the figures. A golf club is generally understood to comprise a club head, which is configured to receive a shaft. A golf club further comprises a grip, which is secured to the shaft.

FIGS. 1-9 schematically illustrate various embodiments of a driver-type golf club head in various views. The features discussed below are demonstrated on club head 100. For ease of discussion, the features shown on club head 100 are applicable to various embodiments of the club head according to the present invention. Any one or more of the features described in the various embodiments below can be used in combination with one another.

The club head 100 can comprise a strike face 102 and a body 101 secured together to define a substantially closed/hollow interior cavity. The club head 100 comprises a crown 110, a sole 112 opposite the crown 110, a heel 104, a toe 106 opposite the heel 104, a front end 108, and a rear end 111 opposite the front end 108. The body 101 can further include a skirt 114 and/or a trailing edge 109 located between and adjoining the crown 110 and the sole 112. The skirt 114 can extend from near the heel 104 to near the toe 106 of the club head 100.

A "driver-type golf club head," also referred to as a driver, as described herein, can be defined by specific dimensional ranges. In particular, the driver, as described with regard to the invention disclosed herein, includes a loft angle, volume, length, depth, and height within the ranges defined below.

The "loft angle" of the driver can be less than approximately 16 degrees, less than approximately 15 degrees, less than approximately 14 degrees, less than approximately 13 degrees, less than approximately 12 degrees, less than approximately 11 degrees, or less than approximately 10 degrees.

The volume of the driver can be greater than approximately 300 cm3, greater than approximately 350 cm3, greater than approximately 400 cm3, greater than approximately 425 cm3, greater than approximately 450 cm3, greater than approximately 475 cm3, greater than approximately 500 cm3, greater than approximately 525 cm3, greater than approximately 550 cm3, greater than approximately 575 cm3, greater than approximately 600 cm3, greater than approximately 625 cm3, greater than approximately 650 cm3, greater than approximately 675 cm3, or greater than approximately 700 cm3.

The club head 100 can comprise one or more body materials such as steel, stainless steel, tungsten, aluminum, titanium, vanadium, chromium, cobalt, nickel, other metals, or metal alloys. In some embodiments, the body material can comprise a Ti-8Al-1Mo-1V alloy, or a 17-4 stainless steel. In some embodiments, the body material can be formed from C300, C350, Ni (Nickel)-Co(Cobalt)-Cr(Chromium)-Steel Alloy, 565 Steel, AISI type 304 or AISI type 630 stainless steel, 17-4 stainless steel, a titanium alloy, for example, but not limited to Ti-6-4, Ti-3-8-6-4-4, Ti-10-2-3, Ti 15-3-3-3, Ti 15-5-3, Ti185, Ti 6-6-2, Ti-7s, Ti-9s, Ti-92, or Ti-8-1-1 titanium alloy, an amorphous metal alloy, or other similar metals. In some embodiments, one or more portions of the club head 100 can comprise a non-metallic material.

Figure 2:
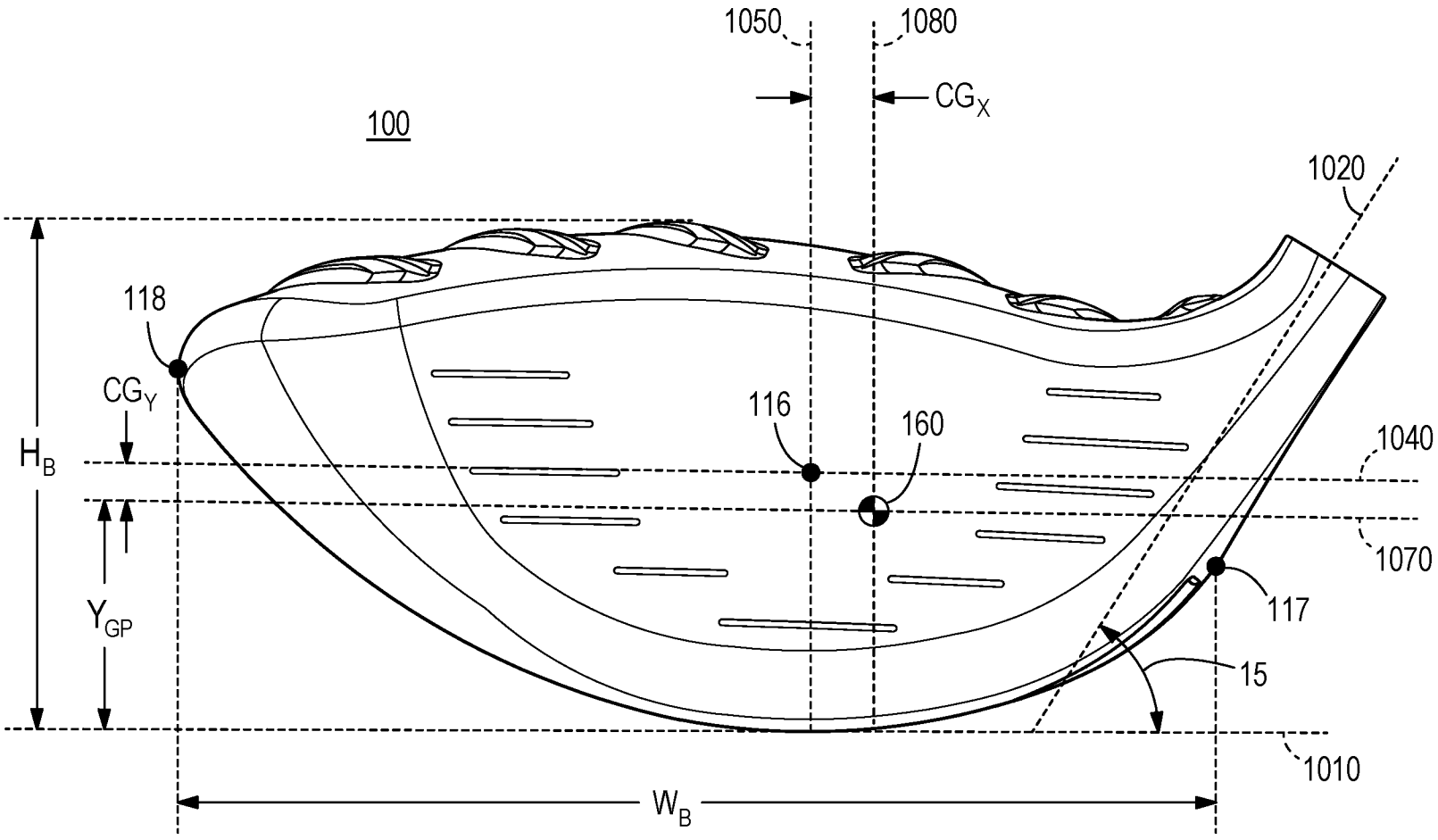
FIG. 2 illustrates a front view of the golf club head of FIG. 1.

The "ground plane," as used herein, refers to a reference plane associated with the surface on which a golf ball is placed. The ground plane 1010 can be a horizontal plane tangent to the sole at an address position. Address position is defined in further detail below. The ground plane 1010 is illustrated in FIG. 2.

Figure 3:
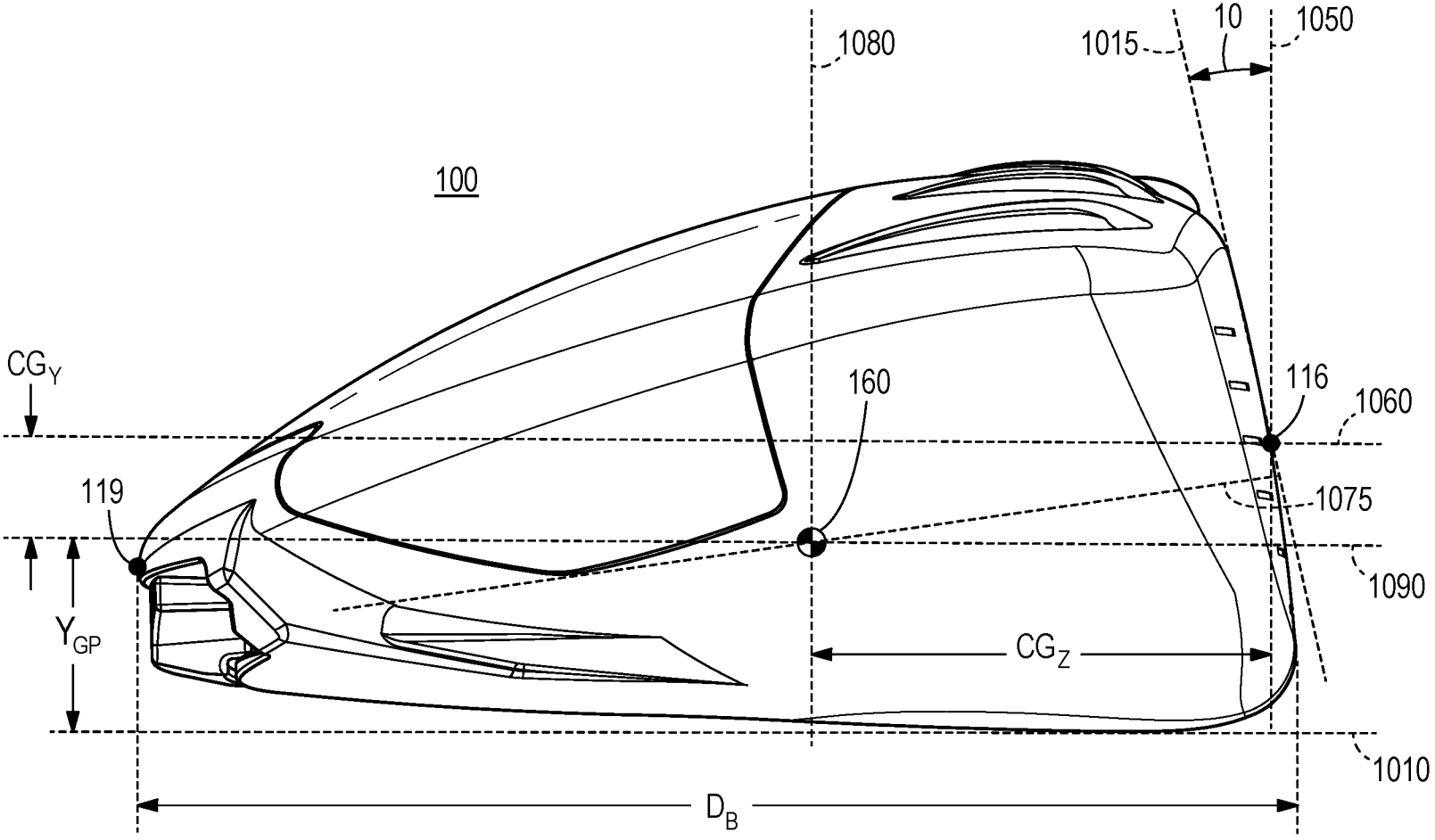
FIG. 3 illustrates a toe side view of the golf club head of FIG. 1.

The "loft plane," as used herein, refers to a reference plane that is tangent to a geometric center of the strike face (the "geometric center" is described in further detail below). Loft plane 1015 is illustrated in FIG. 3.

The term "loft angle," as used herein, can refer to an angle measured between the loft plane 1015 and the XY plane (defined below). Loft angle 10 is illustrated in FIG. 3.

The term "lie angle," as used herein, can refer to an angle between a hosel axis 1020, extending through the hosel 105, and the ground plane. The lie angle 15 is measured from a front view of the club head, as illustrated in FIG. 2.

The club head 100 can define an "address position" (also referred to as "address"), wherein the club head is oriented such that club head forms its intended loft angle 10 and lie angle 15. For example, at address position, the loft plane 1015 and an XY plane form the intended loft angle 10 between one another. Likewise, at address position, the hosel axis 1020 and the ground plane 1010 form the intended lie angle 15 between one another.

As illustrated in FIGS. 2 and 3, the club head 100 can define a primary coordinate system centered about the geometric center 116 of the strike face 102. The primary coordinate system can comprise an X-axis 1040, a Y-axis 1050, and a Z-axis 1060. The X-axis 1040 can extend in a heel-to-toe direction, parallel to the ground plane 1010. The X-axis 1040 can be positive towards the heel 104 and negative towards the toe 106. The Y-axis 1050 can extend in a crown-to-sole direction and can be orthogonal to both the ground plane 1010 and the X-axis 1040. The Y-axis 1050 can be positive towards the crown 110 and negative towards the sole 112. The Z-axis 1060 can extend in front-to-rear direction, parallel to the ground plane 1010, and can be orthogonal to both the X-axis 1040 and the Y-axis 1050. The Z-axis 1060 can be positive towards the strike face 102 and negative towards the rear end 111.

The primary coordinate system, as described herein, defines an XY plane as a vertical plane extending along the X-axis 1040 and the Y-axis 1050. The primary coordinate system defines an XZ plane as a horizontal plane extending along the X-axis 1040 and the Z-axis 1060. The primary coordinate system further defines a YZ plane as a vertical plane extending along the Y-axis 1050 and the Z-axis 1060. The XY plane, the XZ plane, and the YZ plane are all perpendicular to one another and intersect at the primary coordinate system origin located at the geometric center 116 of the strike face 102. In these or other embodiments, the club head 100 can be viewed from a front view when the strike face 102 is viewed from a direction perpendicular to the XY plane. Further, in these or other embodiments, the club head 100 can be viewed from a side view or side cross-sectional view when the heel 104 or toe 106 is viewed from a direction perpendicular to the YZ plane.

Figure 4:
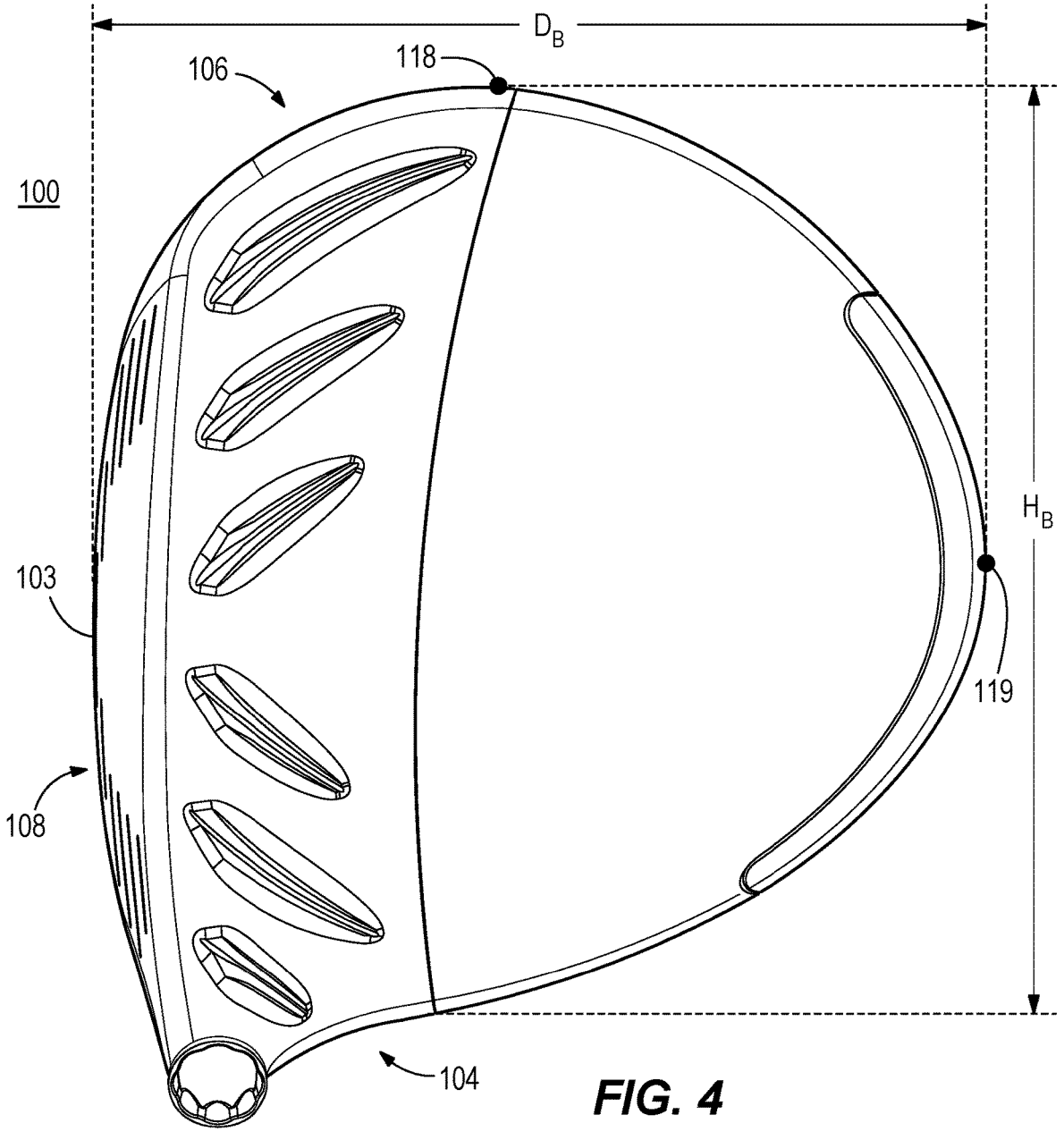
FIG. 4 illustrates a top view of the golf club head of FIG. 1.

The "body depth," or "depth" DB of the club head 100, as used herein, refers to a front-to-rear dimension measured across the body 101. Referring to FIGS. 3 and 4, the body depth DB is measured parallel to the Z-axis 1060 from a leading edge 103 to a rearward-most point 119 of the body 101. In many embodiments, the body depth DB can be measured according to a golf governing body such as the United States Golf Association (USGA).

The "body height," or "height" HB of the club head 100, as described herein, can refer to a crown-to-sole dimension measured across the body 101. Referring to FIG. 2, the body height HB can be measured as a vertical distance (parallel to the Y-axis 1050) between the ground plane 1010 and the highest point of the crown 110. In many embodiments, the body height HB can be measured according to a golf governing body such as the United States Golf Association (USGA).

The "body width," or "width" WB of the club head 100, as described herein, can refer to a heel-to-toe dimension measured across the body 101. Referring to FIG. 2, the body width WB can be measured parallel to the X-axis 1040 from the heel apex 117 to a toe apex 118. The toe apex 118 is defined as the toeward-most point of the body 101. The heel apex 117 is heelward-most point of the heel 104 that is located at a height 0.875 mm from the ground plane 1010. In many embodiments, the body width WB can be measured according to a golf governing body such as the United States Golf Association (USGA). The ranges specified for the body depth DB, body height HB, and body width WB can be designed in accordance with the USGA regulations.

The "center of gravity" or "CG" of the club head, as described herein, can refer to the point at which the mass is centered within the club head. The CG 160 is illustrated in FIGS. 2 and 3.

The term or phrase "center of gravity position" or "CG location" can refer to the location of the club head center of gravity (CG) with respect to the primary coordinate system, wherein the CG position is characterized by locations along the X-axis 1040, the Y-axis 1050, and the Z-axis 1060. The term "CGx" can refer to the CG location along the X-axis 1040, measured from the geometric center 116. The term "CG height" can refer to the CG location along the Y-axis 1050, measured from the geometric center 116. The term "CGy" can be synonymous with the CG height. The term "CG depth" can refer to the CG location along the Z-axis 1060, measured from the geometric center 116. The term "CGz" can be synonymous with the CG depth.

The golf club head further comprises a secondary coordinate system centered about the center of gravity 160. As illustrated in FIGS. 2 and 3, the secondary coordinate system comprises an X'-axis 1070, a Y'-axis 1080, and a Z'-axis 1090. The X'-axis 1070 extends in a heel-to-toe direction. The X'-axis 1070 is positive towards the heel 104 and negative towards the toe 106. The Y'-axis 1080 extends in a sole-to-crown direction and is orthogonal to both the Z'-axis 1090 and the X'-axis 1070. The Y'-axis 1080 is positive towards the crown 110 and negative towards the sole 112. The Z'-axis 1090 extends front-to-rear, parallel to the ground plane 1010 and is orthogonal to both the X'-axis 1070 and the Y'-axis 1080. The Z'-axis 1090 is positive towards the strike face 102 and negative towards the rear end 111.

The term or phrase "moment of inertia" (hereafter "MOI") can refer to a value derived using the center of gravity (CG) location. The term "MOIxx" or "Ixx" can refer to the MOI measured about the X'-axis 1070. The term "MOIyy" or "Iyy" can refer to the MOI measured about the Y'-axis 1080. The term "MOIzz" or "Izz" can refer to the MOI measured about the Z'-axis 1090. The MOI values MOIxx, MOIyy, and MOIzz determine how forgiving the club head 100 is for off-center impacts with a golf ball.

MOI is a measurement of an object's resistance to twisting about a given axis and is calculated according to Equation 1 below.

$$I=\int r^2 dm \quad \text{(Eqn. 1)}$$

Equation 1 defines MOI, represented by I, of an object as the integral, with respect to mass (represented by dm), of the perpendicular distance between the axis about which MOI is being measured and the location of the mass of the object, represented by r, squared. It is generally known that, if the center of gravity (CG) of an object is known, that object may be treated as a point mass located at said CG. Treating an object as a point mass allows Equation 1 to be simplified to the following equation, Equation 2.

$$I=\Sigma m_i r_i^2 \quad \text{(Eqn. 2)}$$

Equation 2 describes that the moment of inertia, I, of an object about a given axis is equal to the sum of the masses of all point masses of that object multiplied by the perpendicular distance between the axis about which MOI is being measured and each of the point masses.

The term "strike face," as used herein, refers to a club head front surface that is configured to strike a golf ball. The term strike face can be used interchangeably with the term "face" or "strike face surface".

The strike face comprises a "bulge curvature", and a "roll curvature". The bulge curvature is the curvature of the strike face in the heel-to-toe direction. The roll curvature is the curvature of the strike face in a crown-to-sole direction. The bulge curvature and the roll curvature each respectively comprise a "bulge radius" and a "roll radius" defining the radii of curvature associated with each of the bulge curvature and the roll curvature. The bulge curvature and/or the roll curvature can comprise one or more radii. The bulge and roll radii are designed and selected to improve off center hits of the golf ball. The bulge and roll radii define the boundaries of the strike face and the strike face perimeter.

Figure 5:
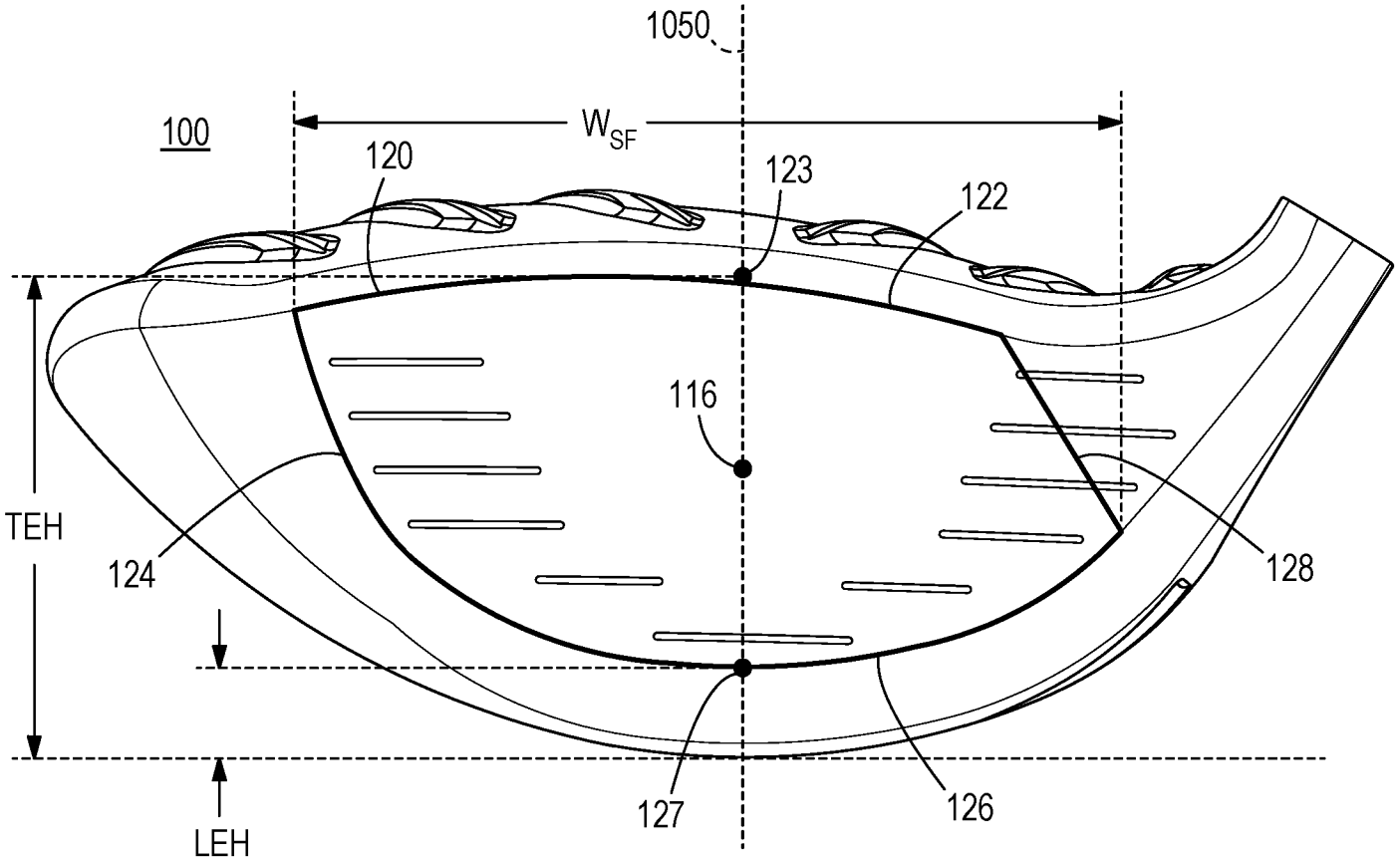
FIG. 5 illustrates a front view of the golf club head of FIG. 1.

The term "strike face (SF) perimeter," as used herein, can refer to an edge of the strike face. The SF perimeter 120 is located and defined at the point where the bulge radius and roll radius deviate from the bulge curvature and roll curvature, respectively. Referring to FIG. 5, the strike face perimeter includes a top edge 122, a toe edge 124, a bottom edge 126, and a heel edge 128. The strike face perimeter is the outermost bound of the strike face 102.

The "leading edge" of the club head, as described herein, can be identified as the most forward portion of the club head 100. The leading edge 103 is not necessarily a part of the strike face 102. The leading edge 103 may be located just below the bottom of the strike face bottom edge 126. For example, as illustrated in FIG. 5, the leading edge 103 is within the transition from the strike face 102 to the sole 112 of the club head 100.

Figure 6:
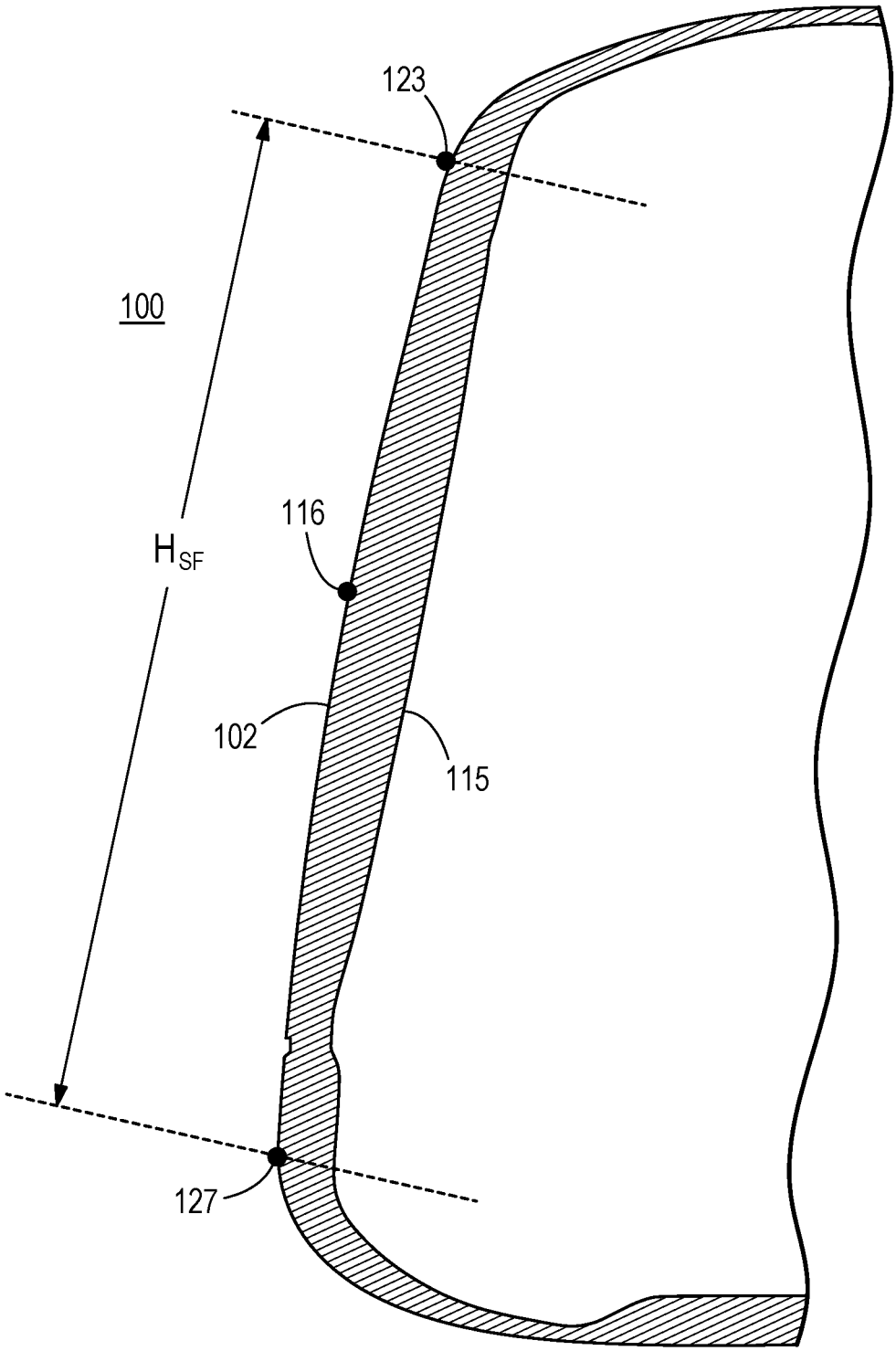
FIG. 6 illustrates a cross sectional detailed view of the golf club head of FIG. 1.

The "strike face height" or "face height" HSF of the club head, as used herein, refers to a distance measured from a strike face top edge point 123 to a strike face bottom edge point 127 within the YZ plane. The strike face top edge point 123 is defined by the intersection of the strike face top edge 122 and the YZ plane. Similarly, the strike face bottom edge point 127 is defined by the intersection of the strike face bottom edge 126 and the YZ plane. Referring to FIG. 6, the height HSF can be measured parallel to the loft plane 1015, from the SF top edge point 123 to the SF bottom edge point 127, in the YZ plane which intersects face center 116.

The "strike face width" WSF of the club head, as used herein, refers to a horizontal distance measured across the strike face in a heel-to-toe direction. Referring to FIG. 5, the strike face width WSF can be measured parallel to the ground plane 1010, from a heelward-most point of the strike face perimeter to a toeward-most point of the strike face perimeter.

Figure 7:
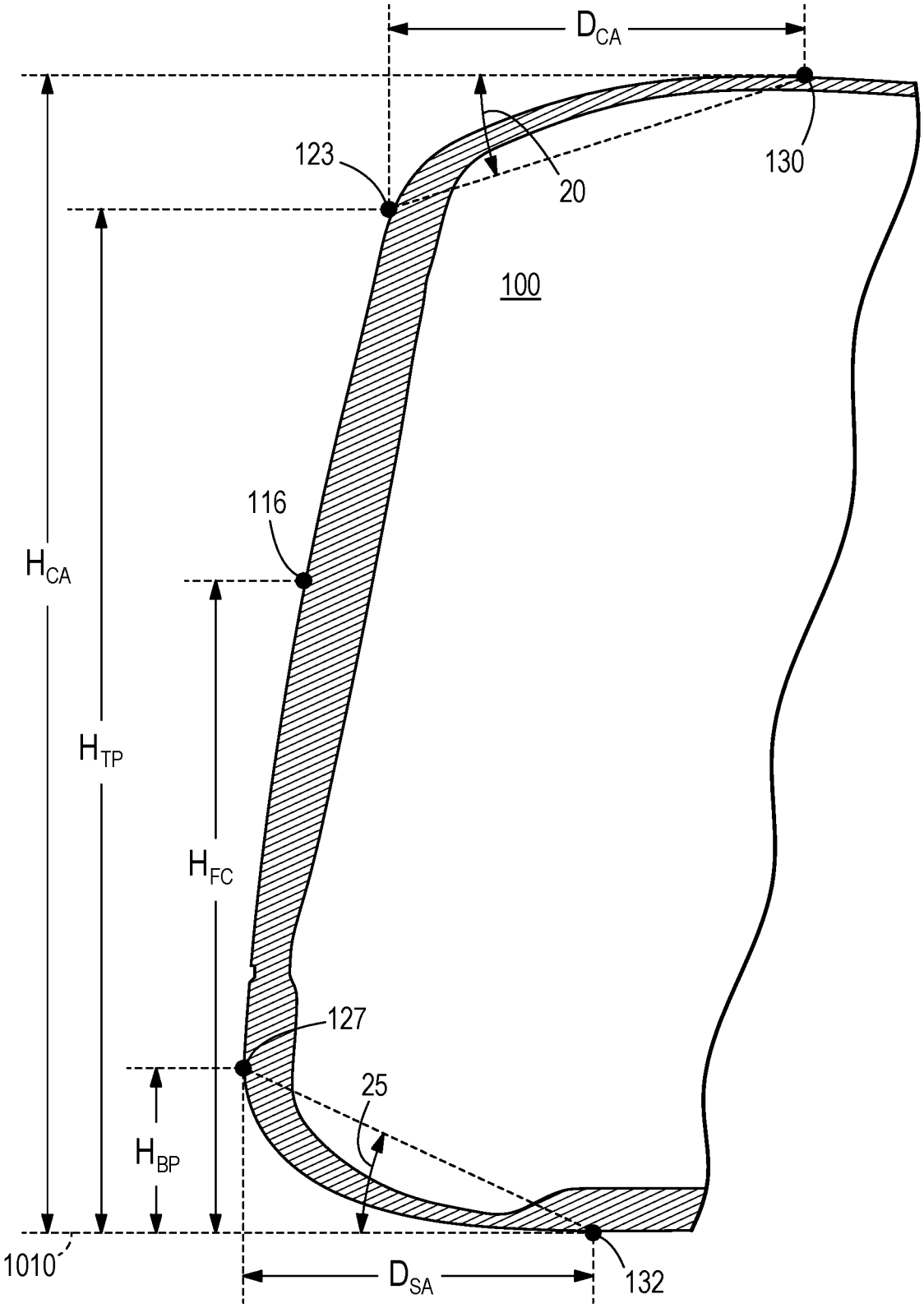
FIG. 7 illustrates a cross sectional detailed view of the golf club head of FIG. 1.

The "top edge point height" HTP of the club head, as used herein, refers to the distance measured between the top edge point 123 and the ground plane 1010, perpendicular to the ground plane, as illustrated in FIG. 7. The strike face top edge point 123 is defined by the intersection of the strike face top edge 122 and the YZ plane.

The "bottom edge point height" HBP of the club head, as used herein, refers to the distance measured between the bottom edge point 127 and the ground plane 1010, perpendicular to the ground plane, as illustrated in FIG. 7. The strike face bottom edge point 127 is defined by the intersection of the strike face bottom edge 126 and the YZ plane.

The "crown apex height" HCA of the club head, as used herein, refers to the distance measured between a crown apex point 130 and the ground plane 1010, perpendicular to the ground plane, as illustrated in FIG. 7. The crown apex point 130 is the highest point on the crown 110 in the YZ plane.

The "crown apex depth" DCA of the club head, as used herein, refers to the distance measured between the top edge point 123 and the crown apex point 130 in the YZ plane, parallel to the Z-axis 1060.

The "crown apex angle" 20 of the club head, as used herein, refers to the angle of the crown apex point 130 relative to the top edge point 123. The crown apex angle 20 is measured as the angle between a line parallel to the Z-axis which intersects the crown apex point 130 and a line intersecting both the crown apex point 130 and top edge point 123.

The "sole apex depth" DSA of the club head, as used herein, refers to the distance measured between the bottom edge point 127 and a sole apex point 132. The sole apex point 132 is the lowest point on the sole 112 in the YZ plane and the point on the sole 112 in which the ground plane 1010 is tangent to.

The "sole apex angle" 25 of the club head, as used herein, refers to the angle of the sole apex point 132 relative to the ground plane 1010. The sole apex angle 25 is measured between a line which intersects the bottom edge point 127 and the sole apex point 132 and a the ground plane 1010.

The "geometric center" of the strike face, as used herein, refers to a geometric center point of the strike face perimeter, illustrated in FIGS. 2 and 5. The geometric center point 120 of the strike face 102 can be located in accordance with the definition of a golf governing body such as the United States Golf Association (USGA).

As illustrated in FIG. 6, the strike face 102 comprises a face center height HFC. The face center height HFC is measured from the ground plane 1010 to the geometric center 116, perpendicular to the ground plane 1010.

As illustrated in FIG. 3, the club head 100 further comprises a force line 1075 intersecting the center of gravity 160 and extending perpendicular to the loft plane 1015. The launch characteristics of a golf ball are dependent on the relationship between the force line 1075 and the impact location of the golf ball on the strike face. The closer the impact location is to the force line 1075, the greater the energy transfer between the club head 100 and the golf ball at impact. The force line 1075 can be positioned offset relative to the face center 116 to adjust launch characteristics, assuming the golf ball will be struck at the face center.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Description

Described herein is a driver-type club head comprising a face height to face thickness ratio which produces greater ball speeds while being at or below the CT limit. The club head described herein is not a fairway-type golf club head. The club head described herein is not a hybrid-type golf club head. Specifically, the driver-type golf club head comprises a shallower (i.e. shorter face height) and thinner strike face compared to known driver-type golf club heads to increase ball speed while maintaining a CT at or below the United States Golf Association ("USGA") limit. In many embodiments, the driver-type golf club head 100 comprising the shallower and thinner strike face provides at least a 1 mph ball speed increase while maintaining a CT at or below the USGA limit when compared to driver-type golf club heads comprising a large strike face including a large face height and/or a thick strike face.

I. Theoretical Discussion

It is an aspect of the present invention to provide a strike face that is as thin as possible while maintaining a conforming CT value and providing a sufficiently durable club head. The present disclosure recognizes that the thickness of the strike face is the dominant parameter that affects ball launch speed. The strike face thickness affects the ball speed greater than any other design parameter, especially in driver-type club heads. However, strike face thickness also affects the CT value. If all other structural parameters remain the same, simply making a thinner face will raise the CT value and will raise the ball launch speed. However, when the strike face is made thinner, there is a potential to exceed the CT limit set out by the USGA. The present disclosure identifies parameters working in concert with strike face thickness that can lower the CT value, so that the CT value is maintained within the USGA CT limit. By adjusting parameters other than just the strike face thickness, ball speed will be reduced as well, but not reduced as much as it was increased by the thinner strike face, resulting in a net gain of ball speed.

It is an aspect of the present invention to shorten or reduce the strike face height as a means to reduce the CT of the golf club head to be within the USGA CT limit. The strike face height (or size) has been recognized, as mentioned above, to affect the ball speed. In addition to the strike face height effects on the ball speed, the strike face height will also affect the CT value. Contrary and counterintuitively to the prior art, the present disclosure aims to reduce the strike face height (and total strike face volume). The present disclosure aims to reduce the strike face height as a means to lower the CT value so that the strike face can be made as thin as possible. The ball speed gained from reducing the strike face thickness will more than offset the ball speed loss resulting from reducing the striking face height, thereby resulting in a net gain in ball speed.

The driver-type golf club head described herein comprising a shallower and thinner face will also provide mass property benefits. A shallower and thinner strike face will provide a lighter, lower mass strike face so that more mass may be moved to other desirable locations. The mass removed from the strike face can be moved to club head locations such as along the perimeter and at the rear to increase MOI and improve the center of gravity location. For example, the face plate of the driver-type golf club head described herein comprises a mass of approximately 30 g. In other embodiments, the mass of the face plate can range between approximately 22 g and 32 g.

Many structural factors other than strike face height and strike face thickness can affect CT and ball speed. However, many of those other methods of CT control are more complicated, adding cost and potential quality control issues. Many prior art structures used to control CT require additional forming operations or additional materials, increasing mass in a forward portion of the prior art golf club heads and causing additional costs. The driver-type golf club head described herein maintains CT without requiring many of the known methods for controlling CT. The driver-type golf club head described herein does not require any ribs, braces, springs, or struts connecting an interior sole, skirt, crown toe, or heel surface to an interior strike face surface before or during flexure at impact, other than a weld line, brazing interface, or adhesion surface between the strike face and the club head body at the strike face perimeter. The driver-type golf club head strike face insert described herein does not require multiple materials having distinct boundaries. The driver-type golf club strike face described herein does not require any polymeric materials adhering to the strike face interior surface. The driver-type golf club head described herein does not require any channels, slots, or other flexure features formed in or attached to the crown, sole, toe, skirt, or heel portions unless specifically described herein. The driver-type golf club described herein does not require any channels, slots, or other flexure features formed in or attached to the strike face or front portion in any location unless specifically described herein. The driver-type golf club head described herein does not require any structure connecting an interior crown surface to an interior sole surface. The driver-type golf club head described herein does not require structures connecting an interior toe surface to an interior heel surface. The driver-type golf club described herein takes a geometry-based approach to increase ball speed while maintaining CT.

A. Ball Speed

As noted above, the launch speed of the golf ball, when struck by a driver-type golf club head, is determined, in part, by the two characteristics of the strike face. For a constant club head impact speed and strike face impact location, the strike face height and strike face thickness will determine the launch speed. As the strike face height increases, while holding all other features constant, the launch speed of the struck golf ball will increase. Contrariwise, the launch speed of the struck golf ball will decrease as the strike face height decreases, holding all other features constant. This is true within the allowed volumetric constraints for a driver-type golf club head as established by the USGA. As the strike face thickness decreases, the launch speed of the struck golf ball will increase. Contrariwise, the launch speed of the struck golf ball will decrease as the strike face thickness increases. (This is true for the practical range of club head swing speeds, between 50 mph and 150 mph).

The claimed driver-type golf club head reduces the strike face thickness in a specific fashion. The strike face's outer surface is required by the USGA rules to be smoothly curved. That is, the strike face outer surface does not comprise bumps or recesses, but instead is a smoothly curved surface having bulge and roll radii that are approximately constant across the strike face. The inner surface (or rear surface) of the strike face may have recesses or bumps that are not smooth or uniform. The strike face inner surface provides the topography for a variable strike face thickness. According to examples disclosed herein, strike face thickness is reduced by uniformly reducing the outer surface while maintaining the inner surface topography. Stated another way, the reduced strike face thickness may be visualized as though a strike face is uniformly milled on the smooth curved outer surface, making any given point on the strike face a constant amount thinner. The strike face may still have a variable face thickness, but the cross-sectional width at each point will be a constant amount thinner. Average face thickness is calculated by dividing the strike face volume by the strike face front surface area.

Referring to FIGS. 2 and 3, in one embodiment the golf ball launch speed at impact is linearly related to the strike face height. For a constant club head impact speed and strike face impact location, as the strike face height increases, the ball speed at launch increases. For a constant club head impact speed and strike face impact location, as the strike face height decreases, the ball speed at launch decreases. For the embodiment illustrated in FIG. 6, a 0.2-inch strike face height decrease leads to approximately a 1.5 mph decrease in ball launch speed. A 0.2-inch strike face height increase leads to approximately a 1.5 mph increase in ball launch speed.

Figure 8:
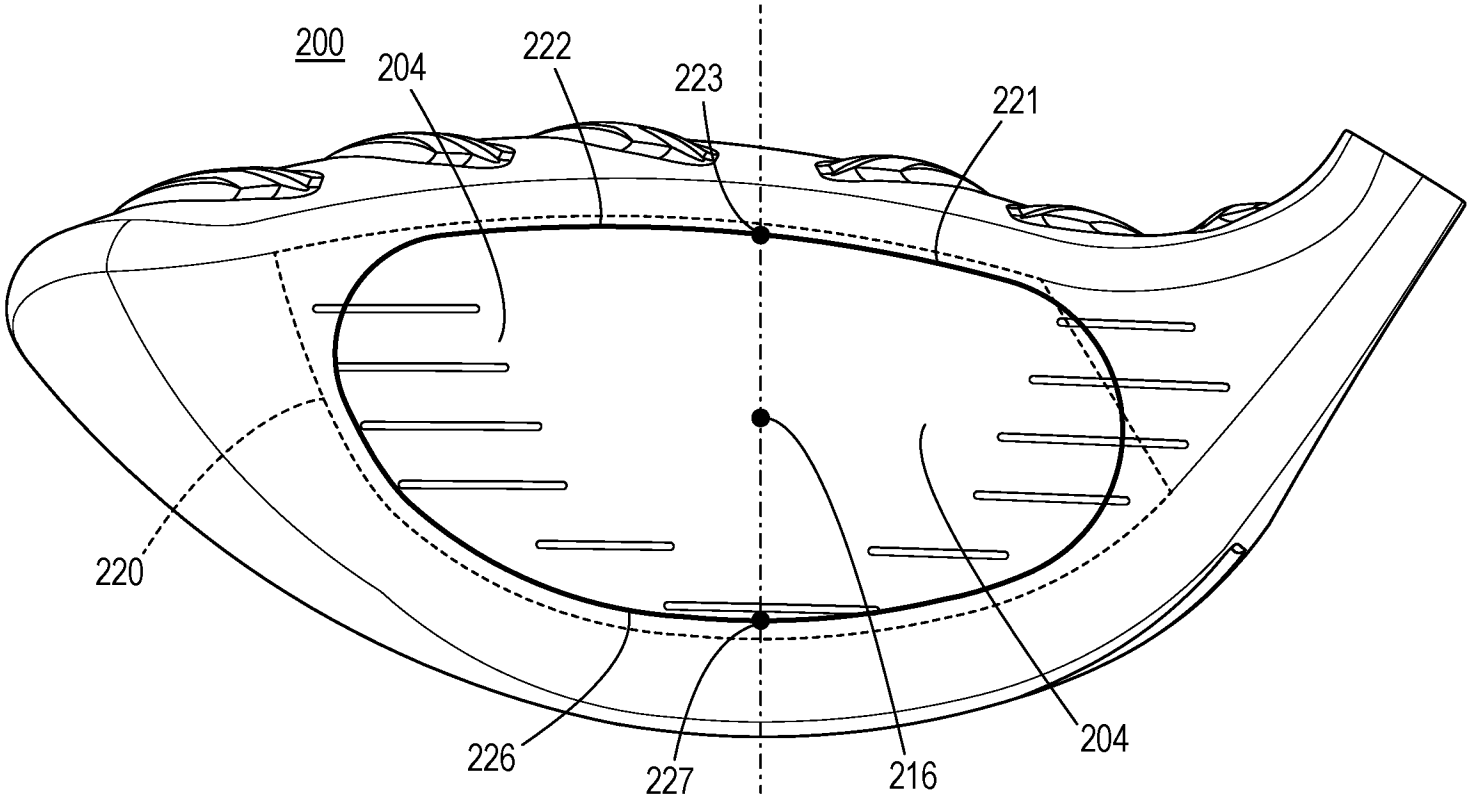
FIG. 8 illustrates a front view of a golf club head according to an embodiment.

Referring to FIG. 8, in one embodiment the golf ball launch speed at impact is linearly related to a change of strike face thickness as described above. For the embodiment illustrated in FIG. 8, the golf ball launch speed measured in mile-per-hour (mph) is inversely and linearly related to strike face thickness. This equation demonstrates that as the strike face thickness increases, the ball speed decreases, and when the strike face thickness decreases, then the ball speed increases in an essentially linear fashion.

B. Contact Time (CT)

As noted above, the contact time (CT) of a given golf club strike face is determined by several factors. Strike face height and strike face thickness, independently from other factors, directly affect the golf club head CT. Referring to FIG. 7, the CT of the strike face is plotted against a change in strike face height. For a constant club head impact speed and strike face impact location, as the strike face height increases, the CT of the strike face also increases. In a similar fashion, as the strike face height decreases, the CT of the strike face decreases. Increasing the strike face height increases the strike face CT. Decreasing the strike face height decreases the strike face CT. Increasing the strike face thickness increases the strike face CT. Decreasing the strike face thickness decreases the strike face CT. In golf club design, controlling the strike face CT to remain within the USGA limits is desirable; however, a higher CT allows more energy to be transferred to the golf ball when it is struck.

C. Tradeoff Between CT Control and Ball Speed Increase

Referring to FIGS. 6-9, The $|\Delta CT|$ caused by a change in face thickness is equal to or less than the $|\Delta CT|$ caused by a change in face height. The $|\Delta BS|$ caused by a change in face thickness is greater than the $|\Delta BS|$ caused by a change in face height. Thus, when the strike face average face thickness is properly reduced from a comparative driver-type golf club head, and the strike face height is properly reduced from a comparative driver-type golf club head, then the $\Delta CT$ is 0 or negative. However, the $\Delta BS$ is positive. Stated another way, two strike face thickness functions are defined as BS(FT) illustrated in FIGS. 6-9, and CT(FT) illustrated in FIG. 6-9. Similarly, two strike face height functions are defined as BS(FH) and CT(FH), illustrated in FIGS. 6-9, respectively. A ratio of the strike face thickness effect on ball speed at launch and the strike face thickness effect on CT is $(\Delta BS(FT))/(\Delta CT(FT))$, where the units are mph/μs. A ratio of the strike face height effect on ball speed at launch and the strike face height effect on CT is $(\Delta BS(FH))/(\Delta CT(FH))$, where the units are mph/μs. The described driver-type golf club head gains ball speed at launch without increasing the strike face CT. Then $(\Delta BS(FT))/(\Delta CT(FT)) > (\Delta BS(FH))/(\Delta CT(FH))$. In other words, adjusting face thickness provides a greater ball speed change per unit of CT (microseconds) than adjusting the face height.

D. Performance Goals and Tradeoffs

As discussed above, one problem facing golf club head designers is the tradeoff between increasing the launch speed of the golf ball when struck, the durability of the golf club head when repeatedly striking a golf ball, and keeping the golf club head CT within the USGA rule limits. If the USGA CT limits did not exist, then a strike face thickness would be minimized, and a strike face height would be maximized within the durability properties of any given strike face material. However, the USGA CT limits do exist, and existing driver-type golf club heads have progressively enlarged the golf club head strike face to maximize ball speed within the CT limitations. The disclosed driver-type golf club head takes a somewhat different approach. Instead of seeking to increase strike face size, a driver-type golf club head having a smaller strike face can be designed to increase ball speed over the ball speed achieved by club heads having a larger strike face. Three specific relationships are combined to achieve a higher ball speed: 1) When strike face height is decreased and all other factors are held equal, the golf club head CT will decrease; 2) When the strike face thickness is decreased the ball speed will increase; and 3) When the strike face thickness is decreased, the golf club head CT will increase. Key to these three relationships is the relative effect of each. Decreasing strike face height lowers CT proportionally faster than decreasing strike face thickness raises CT. Thus, a particular range of lower strike face heights provides for a thinner strike face-enabled ball speed increase while not exceeding the USGA CT limit. All things being equal, a higher ball launch speed achieves a longer carry distance. However, other trade-offs in driver-type golf club head performance must also be managed.

The strike face height must be managed with golf club head mass properties in view. The lower strike face height proportionally lowers the strike face geometric center. Therefore, the golf club head CG projection perpendicular to the loft plane would then be proportionally higher relative to the strike face geometric center, changing the launch ball spin to a lower spin rate. Without additional design accommodation, the additional shot distance following from a higher ball speed, achieved by the shorter, thinner strike face, would be reduced by a lower launch spin rate. It is advantageous, in terms of spin, to have a CG lower in the golf club head relative to the loft normal axis. This trade-off has led to increasingly taller golf club head strike faces in the industry, as designers use a taller strike face to achieve lower ball spin rates at launch. (A taller face raises the geometric center. A higher geometric center raises the loft normal axis. A higher loft normal axis can provide a better CG offset from the loft normal axis to improve ball spin at launch.)

Still further, the mass distribution of the driver-type golf club head 100 is directly affected by a shorter, thinner strike face because that strike face has less mass. In order to keep the golf club head's total mass in the desirable range, that mass that is removed from the strike face must be allocated elsewhere on the golf club head body. The golf club head moment of inertia (MOI) is also affected by the distribution of mass. Achieving the highest possible MOI within the other constraints is also desirable. Further, strike face height and thickness must be managed with durability in view, as excessively thin strike face thicknesses will cause and the golf club head to fail during use. Described below are embodiments of a driver-type golf club head that achieve a desirable higher ball speed at launch, thereby facilitating an increased carry distance, while also retaining desirable durability, play enhancing mass properties, and CT values within USGA requirements.

E. Ball Spin

The spin rate of the golf ball at launch, typically expressed in revolutions per minute (RPM), affects the carry distance of the shot. Generally, a decrease in RPM provides for a 'flatter' shot trajectory resulting in a longer carry distance. Conversely, a higher RPM results in a higher shot trajectory, causing a shorter carry distance. The increased carry distance achieved with the above-discussed increase in ball speed at launch could be offset by a loss of carry distance if ball speed also increases. A small strike face height poses a problem in this regard. Ball spin is tied to the 'gear effect' of the golf club head. If the club head CG is lowered, then the initial spin rate of the ball is decreased. If the club head CG is raised, then the initial spin rate of the ball is increased. Reducing the strike face height, while holding all other geometries equal, such as the bottom edge point height $H_{BP}$, will raise the CG relative to face center thereby increasing spin. In some embodiments, the CG may raise an undesirable amount, resulting in unideal launch conditions.

To combat the non-ideal launch conditions, the strike face geometric center can be raised while also reducing the strike face height. The leading edge can be raised by providing an elevating curvature at the front portion of the sole. This elevating curvature drops the sole apex relative to the leading edge, which also elevates the entire strike face further above the ground plane. The strike face's vertical extent, (the strike face height) can be reduced, while simultaneously elevating the strike face geometric center. When the strike face geometric center is raised through the raising of the leading edge, the center of gravity projection will move relative to the face center. As such, the spin and launch characteristics will change accordingly. For example, as the geometric face center raises through the raising of the leading edge, the center of gravity projection will be lowered relative to the face center.

The club head body mass may be redistributed to change the relative club head CG position by moving mass from the golf club head crown and repositioning that mass lower in the golf club head body. The mass may be redistributed from the reduced mass strike face to a lower position in the golf club head body. Additional mass may also be placed into a removable, high-density weight attached at the lower, rear portion of the golf club head body. Still further, the shaft receiving structure within the hollow interior of the golf club head body may be altered to remove material, and the mass savings from such an alteration may be repositioned lower in the golf club head body. Any of these may be used singly or in combination to lower the club head body CG as the strike face height lowers the strike face geometric center, to improve the golf ball launch spin.

Utilizing the redistributed mass and the elevating curvature, the golf club head CG vertical position relative to the loft normal axis, is 0.1 inches above the loft normal axis to 0.5 inches below the loft normal axis. The comparative club CG vertical position relative to the loft normal axis, 0.1 inches above the loft normal axis to 0.5 inches below the loft normal axis.

G. Durability

One concern in reducing the strike face thickness is a reduction of club head durability. However, a beneficial tradeoff occurs when simultaneously reducing the strike face thickness and the strike face height. As the strike face thickness decreases, club head durability decreases. As strike face height decreases, strike face durability increases. The club head described herein passes a standard durability test, wherein the club face is repeatedly struck with golf balls having a velocity of 120 mph. The club head described herein successfully passes the 2,000 strikes threshold, which indicates strike face durability at least as high as club heads having higher, thicker strike faces.

II. Strike Face Discussion

As described above, the strike face (hereafter 'SF') height $H_{SF}$ and SF thickness $T_{SF}$ are simultaneously reduced to provide a driver-type club head 100 with improved ball speed while maintaining conforming CT. The "strike face height" or "face height" $H_{SF}$ of the club head, as defined above, refers to a distance measured from a strike face top edge point 123 to a strike face bottom edge point 127 within the YZ plane. The strike face top edge point 123 is defined by the intersection of the strike face top edge 122 and the YZ plane. Similarly, the strike face bottom edge point 127 is defined by the intersection of the strike face bottom edge 126 and the YZ plane. Referring to FIG. 6, the height $H_{SF}$ is measured parallel to the loft plane 1015, from the SF top edge point 123 to the SF bottom edge point 127, in the YZ plane which intersects the face center 116.

The SF thickness $T_{SF}$ of the club head is the average strike face thickness measured within the boundary of the strike face perimeter 120. The average thickness can be calculated by taking the volume of the strike face divided by the area. The volume of the strike face is the material bounded by the strike face front surface 102, strike face rear surface 115, and the strike face perimeter 120. The strike face perimeter 120 profile is extended or projected perpendicular to the loft plane rearwardly until it intersects the strike face rear surface 115. This projection defines the perimeter boundary of the volume of the strike face. The strike face area is the area of the front surface 102 bounded by the strike face perimeter 120.

In many embodiments, the strike face height $H_{SF}$ of the driver-type club head 100 ranges from approximately 1.40 to 1.80 inches. In some embodiments, the strike face height $H_{SF}$ can range from approximately 1.40 to 1.45 inches, 1.45 to 1.50 inches, 1.50 to 1.55 inches, 1.55 to 1.60 inches, 1.60 to 1.65 inches, 1.65 to 1.70 inches, 1.70 to 1.75 inches, or 1.75 to 1.80 inches. Further, in some embodiments, the strike face height $H_{SF}$ can be less than 1.80 inches, less than 1.78 inches, less than 1.76 inches, less than 1.74 inches, less than 1.72 inches, less than 1.70 inches, less than 1.68 inches, less than 1.66 inches, less than 1.64 inches, less than 1.62 inches, less than 1.60 inches, less than 1.58 inches, less than 1.54 inches, less than 1.52 inches, less than 1.50 inches, less than 1.48 inches, less than 1.46 inches, less than 1.44 inches, less than 1.42 inches or less than 1.40 inches. In some embodiments, the strike face height can be approximately 1.80 inches, 1.79 inches, 1.78 inches, 1.77 inches, 1.76 inches, 1.75 inches, 1.74 inches, 1.72 inches, 1.71 inches, 1.70 inches, 1.69 inches, 1.68 inches, 1.67 inches, 1.66 inches, 1.65 inches, 1.64 inches, 1.63 inches, 1.62 inches, 1.61 inches, 1.60 inches, 1.59 inches, 1.58 inches, 1.57 inches, 1.56 inches, 1.55 inches, 1.54 inches, 1.53 inches, 1.52 inches, 1.51 inches, 1.50 inches, 1.49 inches, 1.48 inches, 1.47 inches, 1.46 inches, 1.45 inches, 1.44 inches, 1.43 inches, 1.42 inches, 1.41 inches, 1.40 inches. For example, in the illustrated embodiment, the club head 100 comprises a strike face height $H_{SF}$ of approximately 1.622 inches. In other embodiments, the strike face height $H_{SF}$ can range from 1.733 to 1.622 inches.

In many embodiments, the strike face thickness $T_{SF}$ of the driver-type club head 100 ranges from approximately 0.085 inch to 0.110 inch. The strike face thickness $T_{SF}$ can range from 0.085 to 0.090 inch, 0.090 to 0.095 inch, 0.095 to 0.100 inch, 0.100 to 0.105 inch, or 0.105 to 0.110 inch. In other embodiments, the strike face thickness $T_{SF}$ can range from 0.094 to 0.099 inch, 0.090 to 0.097 inch, or 0.095 to 0.103 inch. The strike face thickness $T_{SF}$ can be less than 0.100 inch, less than 0.099 inch, less than 0.098 inch, less than 0.097 inch, less than 0.096 inch, less than 0.095 inch, less than 0.094 inch, less than 0.093 inch, less than 0.092 inch, less than 0.091 inch, or less than 0.091 inch. For example, in some embodiments, the strike face thickness $T_{SF}$ can be about 0.085 inch, 0.086 inch, 0.087 inch, 0.088 inch, 0.089 inch, 0.090 inch, 0.091 inch, 0.092 inch, 0.093 inch, 0.094 inch, 0.095 inch, 0.096 inch, 0.097 inch, 0.098 inch, 0.099 inch, or 0.100 inch. In the illustrated embodiment the strike face thickness $T_{SF}$ is about 0.094 inch. The strike face thickness $T_{SF}$ of the driver-type club head 100 can be reduced due to the reduction of the strike face height $H_{SF}$. The combination of a thin strike face and small strike face height improves ball speed while maintaining a conforming CT value.

The strike face can comprise a max thickness value, measured from the front surface to the rear surface of the strike face, within the strike face perimeter. In many embodiments, the max thickness can range from approximately 0.140 to 0.100 inch. For example, the max thickness can range from approximately 0.100 to 0.105 inch, 0.105 to 0.110 inch, 0.110 to 0.115 inch, 0.115 to 0.120 inch, 0.120 to 0.125 inch, 0.125 to 0.130 inch, 0.130 to 0.135 inch, or 0.135 to 0.140 inch. In some embodiments, the max thickness is approximately 0.100 inch, 0.102 inch, 0.104 inch, 0.106 inch, 0.108 inch, 0.110 inch, 0.112 inch, 0.114 inch, 0.116 inch, 0.118 inch, 0.120 inch, 0.122 inch, 0.124 inch, 0.126 inch, 0.128 inch, 0.130 inch, 0.132 inch, 0.134 inch, 0.136 inch, 0.138 inch, or 0.140 inch. In other embodiments, the strike face max thickness is less than 0.135 inch, less than 0.134 inch, less than 0.133 inch, less than 0.132 inch, less than 0.131 inch, less than 0.130 inch, less than 0.129 inch, less than 0.128 inch, less than 0.127 inch, less than 0.126 inch, less than 0.125 inch, less than 0.124 inch, less than 0.123 inch, or less than 0.122 inch. In the illustrated embodiment, the max thickness is approximately 0.122 inch.

The max thickness of the strike face can be located at various positions on the strike face. In one embodiment, the strike face comprises a max thickness located at the geometric center of the face. In other embodiments, the max thickness may be located at other positions in the face such as heelward, toeward, crownward, or soleward of the geometric center.

Similarly, the strike face can comprise a minimum thickness that can be located at various positions within the strike face perimeter 120. For example, in one embodiment, the strike face minimum thickness can be located at a perimeter most region of the strike face. In other embodiments, the minimum thickness can be located at the geometric center.

The strike face can comprise a minimum thickness ranging from 0.065 inch to 0.080 inch. For example, the minimum thickness can range from 0.065 inch to 0.070 inch, 0.070 inch to 0.075 inch, or 0.075 inch to 0.080 inch. In one embodiment, the minimum strike face thickness is about 0.074 inch.

In many embodiments, the SF area can range from about 4.0 to 5.0 $in^2$. For example, the SF area can range from 4.0 $in^2$ to 4.5 $in^2$, 4.1 $in^2$ to 4.6 $in^2$, 4.2 $in^2$ to 4.7 $in^2$, 4.3 $in^2$ to 4.8 $in^2$, 4.4 $in^2$ to 4.9 $in^2$ or 4.5 $in^2$ to 5 $in^2$. In one embodiment, the SF area can be 4.02 $in^2$, 4.04 $in^2$, 4.06 $in^2$, 4.08 $in^2$, 4.10 $in^2$, 4.12 $in^2$, 4.14 $in^2$, 4.16 $in^2$, 4.18 $in^2$, 4.20 $in^2$, 4.22 $in^2$, 4.24 $in^2$, 4.26 $in^2$, 4.28 $in^2$, 4.30 $in^2$, 4.32 $in^2$, 4.34 $in^2$, 4.36 $in^2$, 4.38 $in^2$, 4.40 $in^2$, 4.42 $in^2$, 4.44 $in^2$, 4.46 $in^2$, 4.48 $in^2$, 4.50 $in^2$. 4.52 $in^2$, 4.54 $in^2$, 4.56 $in^2$, 4.58 $in^2$, 5.60 $in^2$, 4.62 $in^2$, 4.64 $in^2$, 4.66 $in^2$, 4.68 $in^2$, 4.70 $in^2$, 4.72 $in^2$, 4.74 $in^2$, 4.76 $in^2$, 4.78 $in^2$, 4.80 $in^2$, 4.82 $in^2$, 4.84 $in^2$, 4.86 $in^2$, 4.88 $in^2$, 4.90 $in^2$, 4.92 $in^2$, 4.94 $in^2$, 4.96 $in^2$, 4.98 $in^2$, or 5.00 $in^2$. In the illustrated embodiment, the driver-type club head 100 comprises a strike face area of approximately 4.46 $in^2$. The driver-type club head of the present disclosure comprising a shallower and thinner strike face will also have a smaller SF area compared to other contemporary driver-type club heads.

In many embodiments, the SF perimeter 120 can comprise a length measured as the circumference of the strike face perimeter 120. The strike face perimeter length can range from approximately 8.15 inches to 8.90 inches. For example, the strike face perimeter length can range from 8.15 to 8.50 inches, 8.25 to 8.60 inches, 8.35 to 8.70 inches, 8.45 to 8.80 inches, or 8.55 to 8.90 inches. The strike face perimeter length can be 8.15 inches, 8.20 inches, 8.25 inches, 8.30 inches, 8.35 inches, 8.40 inches, 8.45 inches, 8.50 inches, 8.55 inches, 8.60 inches, 8.65 inches, 8.70 inches, 8.75 inches, 8.80 inches, 8.85 inches, or 8.90 inches. For example, in the illustrated embodiment, the SF perimeter has a length of about 8.386 inches.

The height of the strike face can also be measured in a curvilinear manner such that the curvilinear strike face height is measured from the top edge point 123 to the bottom edge point 127, along the front surface of the strike face and includes the bulge and roll curvature. In many embodiments, the curved height of the strike face ranges from approximately 1.40 to 1.80 inches. In some embodiments, the curved height of the strike face can range from approximately 1.40 to 1.45 inches, 1.45 to 1.50 inches, 1.50 to 1.55 inches, 1.55 to 1.60 inches, 1.60 to 1.65 inches, 1.65 to 1.70 inches, 1.70 to 1.75 inches, or 1.75 to 1.80 inches. Further, in some embodiments, the curved height of the strike face can be less than 1.80 inches, less than 1.78 inches, less than 1.76 inches, less than 1.74 inches, less than 1.72 inches, less than 1.70 inches, less than 1.68 inches, less than 1.66 inches, less than 1.64 inches, less than 1.62 inches, less than 1.60 inches, less than 1.58 inches, less than 1.54 inches, less than 1.52 inches, less than 1.50 inches, less than 1.48 inches, less than 1.46 inches, less than 1.44 inches, less than 1.42 inches or less than 1.40 inches. In some embodiments, the curved height of the strike face can be approximately 1.80 inches, 1.79 inches, 1.78 inches, 1.77 inches, 1.76 inches, 1.75 inches, 1.74 inches, 1.72 inches, 1.71 inches, 1.70 inches, 1.69 inches, 1.68 inches, 1.67 inches, 1.66 inches, 1.65 inches, 1.64 inches, 1.63 inches, 1.62 inches, 1.61 inches, 1.60 inches, 1.59 inches, 1.58 inches, 1.57 inches, 1.56 inches, 1.55 inches, 1.54 inches, 1.53 inches, 1.52 inches, 1.51 inches, 1.50 inches, 1.49 inches, 1.48 inches, 1.47 inches, 1.46 inches, 1.45 inches, 1.44 inches, 1.43 inches, 1.42 inches, 1.41 inches, 1.40 inches. For example, in the illustrated embodiment, the club head 100 comprises a curved strike face height of approximately 1.623 inches. In other embodiments, the curved strike face height can range from 1.735 to 1.624 inches.

The top edge point height $H_{TP}$, as defined above, can range between 1.85 inches and 2.20 inches. For example, the top edge point height $H_{TP}$ can range from 1.85 to 2.00 inches, 1.90 to 2.05 inches, 1.95 to 2.10 inches, 2.00 to 2.15 inches, 2.05 to 2.20 inches. In the illustrated embodiment, the top edge point height $H_{TP}$ is about 1.97 inches. In other embodiments, the top edge point height $H_{TP}$ can range between 1.97 and 2.087 inches.

The bottom edge point height $H_{BP}$, as defined above, can range between 0.350 inch and 0.385 inch. For example, the bottom edge point height $H_{BP}$ can range between 0.350 and 0.360 inch, 0.355 and 0.365 inch, 0.360 and 0.370 inch, 0.365 and 0.375 inch, or 0.370 and 0.380 inch. In some embodiments, the bottom edge point height $H_{BP}$ can be about 0.350 inch, 0.352 inch, 0.354 inch, 0.356 inch, 0.358 inch, 0.360 inch, 0.362 inch, 0.364 inch, 0.366 inch, 0.368 inch, 0.370 inch, 0.372 inch, 0.374 inch, 0.376 inch, 0.378 inch, 0.380 inch. In the illustrated embodiment, the bottom edge point height $H_{BP}$ is about 0.367 inch.

The face center height $H_{FC}$, as defined above, can range between 1.100 inches and 1.300 inches. For example, the face center height $H_{FC}$ can range between 1.100 and 1.200 inches, 1.110 and 1.210 inches, 1.120 and 1.220 inches, 1.130 and 1.230 inches, 1.140 and 1.240 inches, 1.150 and 1.250 inches, 1.160 and 1.260 inches, 1.170 and 1.270 inches, 1.180 and 1.280 inches, 1.190 and 1.290 inches, or 1.200 and 1.300 inches. In the illustrated embodiment, the strike face center height $H_{FC}$ is approximately 1.173 inches.

The driver-type golf club head 100 can comprise a ratio of the strike face height $H_{SF}$ to the face center height $H_{FC}$. The ratio of the strike face height $H_{SF}$ to the face center height $H_{FC}$ can be found by dividing the strike face height $H_{SF}$ by the face center height $H_{FC}$. In many embodiments, the ratio of the strike face height $H_{SF}$ to the face center height $H_{FC}$ can range between 1.20 and 1.60. For example, the ratio of the strike face height $H_{SF}$ to the face center height can range between 1.20 and 1.35, 1.25 and 1.40, 1.30 and 1.45, 1.35 and 1.50, 1.40 and 1.55, or 1.45 and 1.60. The ratio of the strike face height $H_{SF}$ to the face center height $H_{FC}$ of the illustrated embodiment is about 1.36.

When the SF height is reduced, the strike face may be made thinner to return more ball speed than what was lost from the strike face height reduction. When the strike face thickness is reduced, it is uniformly reduced. In some embodiments, the strike face thickness is reduced uniformly only in the strike face area such that the surrounding transition regions thickness values are not changed. In other embodiments, the strike face thickness is reduced uniformly only within a strike face insert perimeter. In this embodiment, only the strike face insert thickness is reduced, even though there may be area of the strike face that is outside the area of the strike face insert perimeter.

The driver-type golf club head also comprises a 2D average strike face thickness. The 2D average thickness is the average thickness of the strike face measured in the YZ plane. The 2D average thickness of the strike face can be found by taking the area of the cross section of the face, bounded by the strike face front surface, the strike face rear surface, and the strike face perimeter projected rearwardly normal to the loft plane. The 2D average strike face thickness can range from approximately 0.090 inch to 0.120 inch. For example, the 2D average strike face thickness can range from 0.090 to 0.100 inch, 0.095 to 0.105 inch, 0.100 to 0.110 inch, 0.105 to 0.115 inch, or 0.110 to 0.120 inch. In the illustrated embodiment, the 2D average face thickness is approximately 0.108 inch.

The strike face width $W_{SF}$, as defined above, can range between 3.0 and 4.5 inches. For example, the strike face width $W_{SF}$ can range from 3.0 inches to 3.25 inches, 3.25 to 3.5 inches, 3.5 to 3.75 inches, 3.75 to 4 inches, or 4 inches to 4.5 inches.

The strike face can further comprise a strike face volume. The volume of the strike face is the volume of material bounded by the strike face front surface, strike face rear surface, and the strike face perimeter 120 projected rearwardly normal to the loft plane. The strike face volume can range between 0.410 $in^3$ and 0.500 $in^3$. For example, the strike face volume can range between 0.410 and 0.460 $in^3$, 0.415 and 0.465 $in^3$, 0.420 and 0.470 $in^3$, 0.425 and 0.475 $in^3$, 0.430 and 0.480 $in^3$, and 0.435 and 0.485 $in^3$, 0.440 and 0.490 $in^3$, 0.445 and 0.495 $in^3$, or 0.450 and 0.500 $in^3$.

The strike face can comprise a material with a density ranging from 50 $g/in^3$ to 100 $g/in^3$. For example in some embodiments, the strike face can comprise a material having a density ranging between 50 to 60 $g/in^3$, 60 to 70 $g/in^3$, 70 to 80 $g/in^3$, 80 to 90 $g/in^3$, or 90 to 100 $g/in^3$. In the illustrated embodiment, the density of the strike face is about 72 $g/in^3$.

III. Driver Construction

As described in detail above, the strike face height and strike face thickness are simultaneously reduced to provide a driver with improved ball speed while maintaining conforming CT. The simultaneous reduction of the strike face height $H_{SF}$ and strike face thickness $T_{SF}$, as defined above, can be applied to any driver-type club heads, regardless of construction. However, in some embodiments, the strike face height and strike face thickness can be represented in ways other than what was defined above.

A. Face Insert

Figure 9:
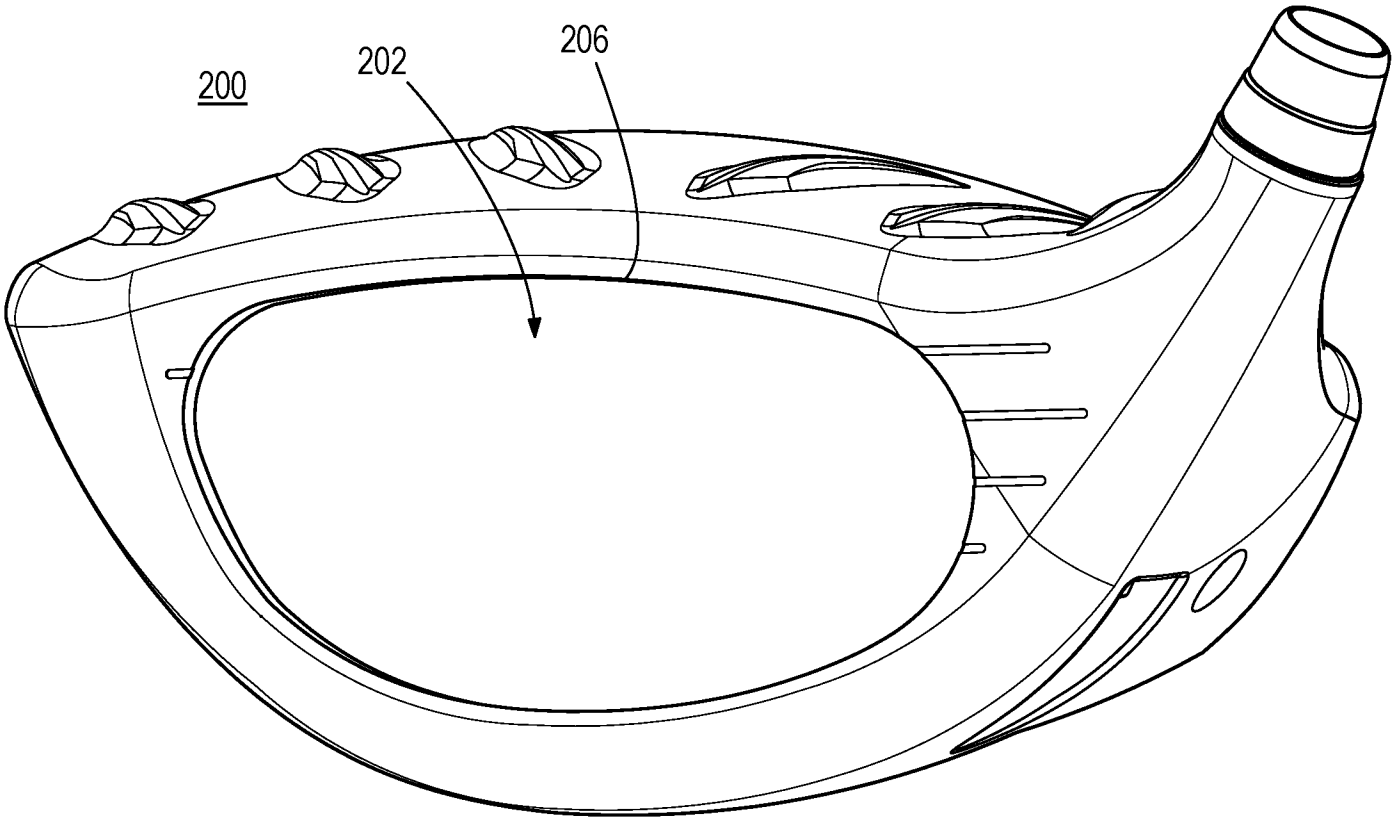
FIG. 9 illustrates a front view of the golf club head of FIG. 8 without a strike face insert.

In some embodiments, the driver-type club head can comprise a strike face insert construction. FIGS. 8 and 9 illustrate an embodiment of a driver-type golf club 200 head which comprises a face insert construction, wherein the golf club head comprises a front opening 202 configured to receive a separately attached strike face insert 204. The face insert comprises a perimeter 221, which can be different than the strike face perimeter 220. The face insert perimeter 221 is the perimeter edge of the face plate insert 204 while the strike face perimeter 220 is defined by the bulge and roll profile, as discussed above. The front opening 202 is sized and shaped to receive the face plate insert 204. In some embodiments, the front opening 202 is approximately the same size and shape as the face insert 204. In other embodiments, the front opening 202 may comprise geometry that facilitate assembly, such as tabs, lap joints, or other similar structures, which the face plate insert rests upon or is configured to mate to. The face insert may be permanently secured or mechanically fastened to the front opening. For example, in one embodiment, the face insert may be welded to the front opening. In other embodiments, the face insert may adhesively secured to or mechanically attached view screws or fasteners, to the front opening.

In this embodiment, the strike face insert comprises a face insert height $H_{FI}$ and a face insert thickness $T_{FI}$. The face insert height refers to a distance measured from a face insert top edge point 223 to a face insert bottom edge point 227 within the YZ plane. The face insert top edge point 223 is defined by the intersection of the face insert top edge 222 and the YZ plane. Similarly, the face insert bottom edge point 227 is defined by the intersection of the face insert bottom edge 226 and the YZ plane. The height $H_{FI}$ can be measured parallel to the loft plane 1015, from the face insert top edge point 223 to the face insert bottom edge point 227, in the YZ plane which intersects face center 216.

The face insert thickness $T_{FI}$ is measured similar to the strike face thickness $T_{SF}$. The face insert thickness can be found by taking the face insert volume divided by the face insert front area. The face insert front area is the area bounded by the face insert perimeter 221.

In many embodiments, the face insert height $H_{FI}$ ranges from 1.35 to 1.70 inches. For examples, the face insert height $H_{FI}$ can range from 1.35 to 1.45, 1.45 to 1.55, 1.55 to 1.65, or 1.65 to 1.70. In some embodiments, the face insert height can be about 1.35 inches, 1.36 inches, 1.37 inches, 1.38 inches, 1.39 inches, 1.40 inches, 1.41 inches, 1.42 inches, 1.43 inches, 1.44 inches, 1.45 inches, 1.46 inches, 1.47 inches, 1.48 inches, 1.49 inches, 1.50 inches, 1.51 inches, 1.52 inches, 1.53 inches, 1.54 inches, 1.55 inches, 1.56 inches, 1.57 inches, 1.58 inches, 1.59 inches, 1.60 inches, 1.61 inches, 1.62 inches, 1.63 inches, 1.64 inches, 1.65 inches, 1.66 inches, 1.67 inches, 1.68 inches, 1.69 inches, or 1.70 inches. In the illustrated embodiment, the face insert height $H_{FI}$ is about 1.49 inches.

In many embodiments, the face insert thickness $T_{FI}$ ranges from 0.085 inch to 0.110 inch. The face insert thickness $T_{FI}$ can range from 0.085 to 0.090 inch, 0.090 to 0.095 inch, 0.095 to 0.100 inch, 0.100 to 0.105 inch, or 0.105 to 0.110 inch. In other embodiments, the face insert thickness $T_{FI}$ can range from 0.094 to 0.099 inch, 0.090 to 0.097 inch, or 0.095 to 0.103 inch. The face insert thickness $T_{FI}$ can be less than 0.100 inch, less than 0.099 inch, less than 0.098 inch, less than 0.097 inch, less than 0.096 inch, less than 0.095 inch, less than 0.094 inch, less than 0.093 inch, less than 0.092 inch, less than 0.091 inch, or less than 0.091 inch. For example, in some embodiments, the face insert thickness $T_{FI}$ can be about 0.085 inch, 0.086 inch, 0.087 inch, 0.088 inch, 0.089 inch, 0.090 inch, 0.091 inch, 0.092 inch, 0.093 inch, 0.094 inch, 0.095 inch, 0.096 inch, 0.097 inch, 0.098 inch, 0.099 inch, or 0.100 inch. In the illustrated embodiment the face insert thickness $T_{FI}$ is about 0.096 inch.

As mentioned above, the face insert (FI) perimeter 221 is separate and distinct from the strike face (SF) perimeter 120. As such, in this embodiment, the golf club head 200 can comprise both a SF perimeter 220 and a FI perimeter 221. The SF perimeter 220 is defined by the bulge and roll, as described above, while the FI perimeter 221 is defined by the edges of the face insert 204. As illustrated in FIG. 8, the SF perimeter 220 is offset outwardly from the FI perimeter 221. As such, the face insert 204 only forms a portion of the total striking surface as defined by the SF perimeter 220 such that the FI area is less than the SF area. In other embodiments, the face insert 204 can form the entirety of the total striking surface as defined by the SF perimeter 220.

In many embodiments, the FI perimeter can range from approximately 7.30 to 8.10 inches. For example, in some embodiments, the face insert perimeter can range from 7.30 to 7.40 inches, 7.40 to 7.50 inches, 7.50 to 7.60 inches, 7.60 to 7.70 inches, 7.70 to 7.80 inches, 7.80 to 7.90 inches, 7.90 to 8.00 inches, or 8.00 to 8.10 inches. In the illustrated embodiment, the face insert has a perimeter of about 7.52 inches.

In many embodiments, the face insert comprises a front surface area ranging from 3.00 $in^2$ to 4.30 $in^2$. For example, in some embodiments, the face insert can comprise a front surface ranging from 3.00 $in^2$ to 3.25 $in^2$, 3.25 $in^2$ to 3.50 $in^2$, 3.50 $in^2$ to 3.75 $in^2$, 3.75 $in^2$ to 4.00 $in^2$, or 4.00 $in^2$ to 4.30 $in^2$.

In some embodiments, the face insert comprises a mass ranging from 15 to 40 grams. For example, in some embodiments, the face insert can have a mass ranging from 15 to 20 grams, 20 to 25 grams, 25 to 30 grams, 30 to 35 grams, or 35 to 40 grams. In the illustrated embodiment, the face insert has a mass of about 25 grams. Due to a shortened face insert height $H_{FI}$, the face insert comprises less mass than a driver without a shortened face. As such, the shortened face height allows for additional discretionary mass savings that may be allocated to other locations in the club head body to improve mass properties such as MOI and CG positions.

In some embodiments, the face insert comprises a volume ranging from 0.244 $in^3$ to 0.550 $in^3$. For example, in some embodiments, the face insert can comprise a volume ranging from 0.244 to 0.300 $in^3$, 0.300 to 0.350 $in^3$, 0.350 to 0.400 $in^3$, 0.400 to 0.450 $in^3$, 0.450 to 0.500 $in^3$, or 0.500 to 0.550 $in^3$. In the illustrated embodiment, the strike face insert has a volume of about 0.359 $in^3$.

In many embodiments, the face insert comprises a width measured as the heelward-most point of the face insert perimeter to the toeward-most point of the face insert perimeter. The face insert width can range from 3.00 inches to 4.00 inches.

B. Face Wrap

A driver with a face wrap construction has a front portion that is formed from a unitary piece such that the strike face surface and transition regions extending rearward are integrally formed and comprise the same material. In the face wrap embodiment, the face wrap may continue rearwardly to form the rest of the body, or the face wrap may be secured to a second, rear body. In a face wrap embodiment, the strike face height and strike face thickness are measured in accordance with the strike face height $H_{SF}$ and strike face thickness $T_{SF}$ defined above and illustrated in FIGS. 6 and 7. A driver-type club head having a face wrap construction can comprise a shallow and thin face, according to aspects of the present invention, to improve ball speed and maintain a conforming CT value.

C. VFT

As mentioned above, providing a driver-type club head with a short strike face height $H_{SF}$ does not depend on the construction of the driver-type club head. Similarly, providing a driver-type club head with a thinner strike face thickness $T_{SF}$ can be measured/applied to any VFT profile or construction. In other words, the present invention achieves increased ball speed while maintaining CT value independent of whether the driver-type club head also has a VFT profile. As mentioned above, to achieve a thinner strike face, the strike face thickness is reduced uniformly across the strike face area. As such, the VFT profile geometries are not changed or altered to account for the change in thickness. Similarly, the VFT profile geometries are not changed or altered to account for the change in height. The consistency of the VFT profile between a driver-type club head comprising a taller and thicker face as compared to an exemplary driver-type club head comprising a shallower and thinner face is illustrated in FIGS. 10 and 11.

Figure 10:
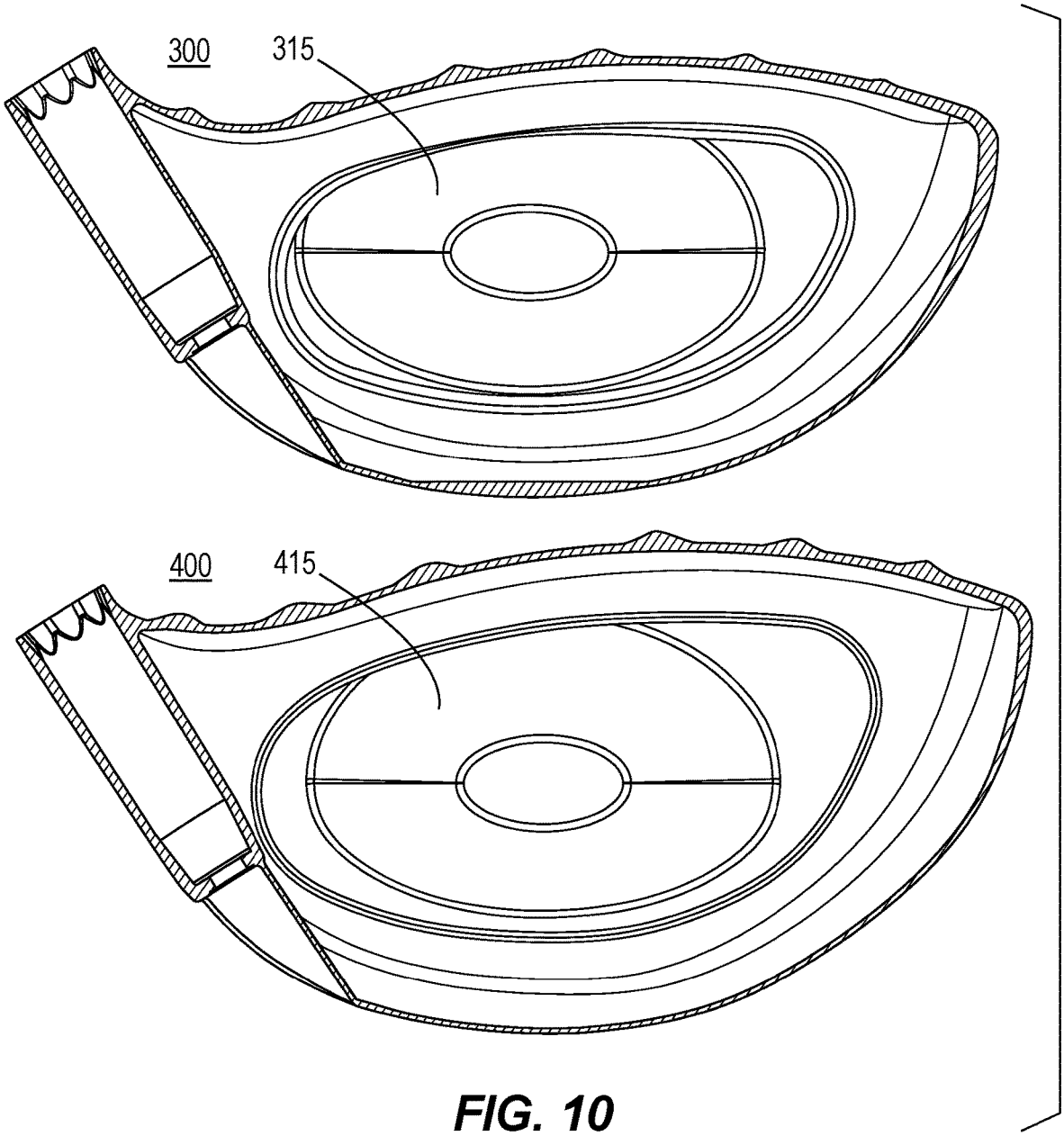
FIG. 10 illustrates a rear internal view of a golf club head according to an embodiment compared to a control club head.

FIG. 10 illustrates an exemplary club head 300, according to aspects of the present invention, comprising a shallow and thin strike face, and a control club head 400. The club head 300 comprises a VFT profile/geometry located on the rear surface 315 of the strike face while the control club head 400 also has a VFT profile on a rear surface 415. The control club head comprises a taller and thicker strike face the exemplary embodiment. As illustrated by FIG. 10, the VFT geometry does not change between the control club head and exemplary club head when the strike face height is reduced.

Figure 11:
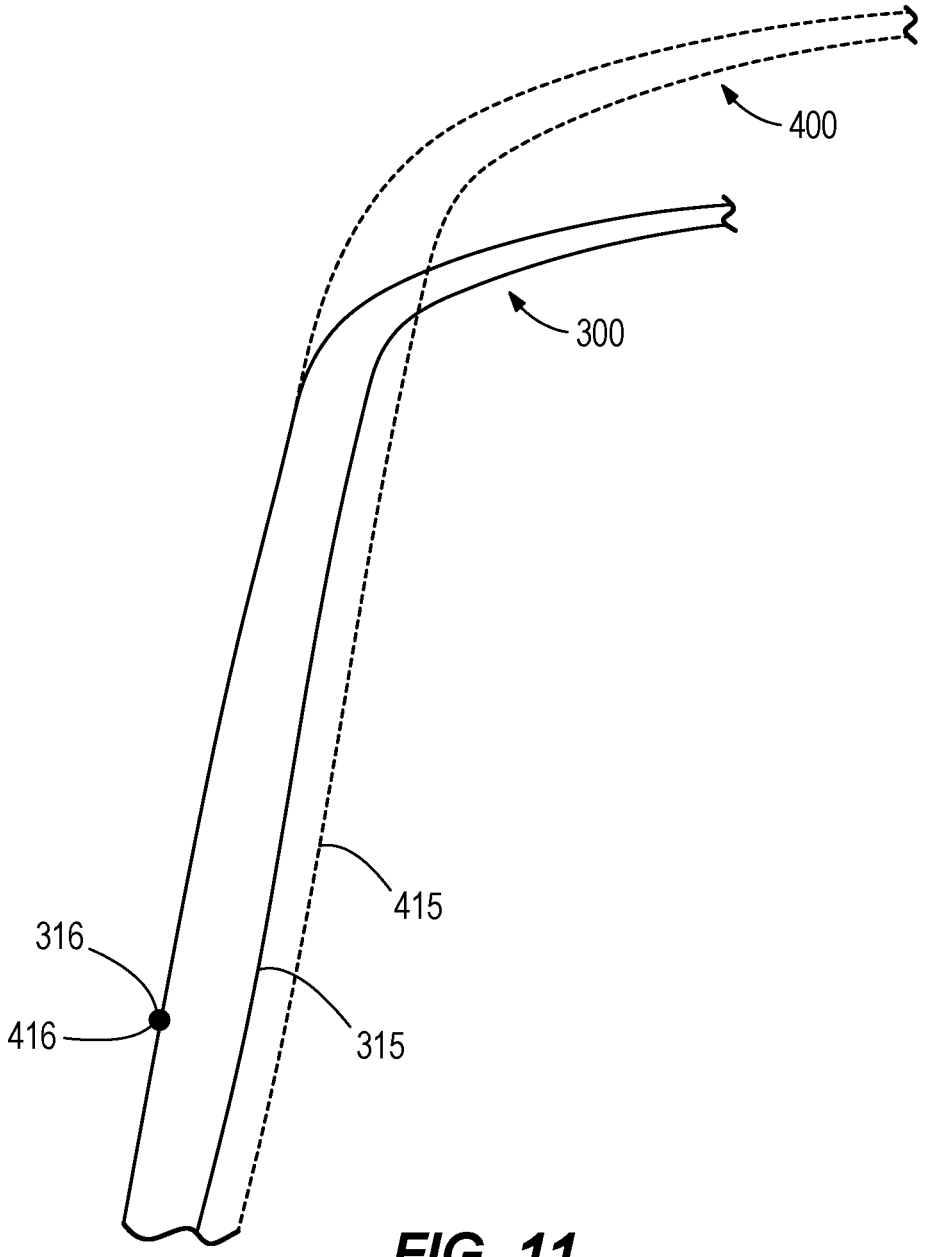
FIG. 11 illustrates a cross sectional view of the club heads of FIG. 10.

FIG. 11 illustrates a cross-sectional comparison of the exemplary club head 300 to the control club head 400. FIG. 11 illustrates how the thickness and face height changes between the control club head 400 and exemplary club head 300 and is not drawn to scale. In FIG. 11, the face center 416, and 316 are coincident. However, the rear surfaces 415 and 315 are offset. The rear surface 315 of the exemplary embodiment, is closer to the face center 316 due to a thinner face thickness. Similarly, the top of the face is also lowered compared to the control club head.

D. Multi-Material Embodiment

In some embodiments, the golf club head can comprise a first component and a second component. The first component comprises the load bearing structure and the majority of the club head mass. The second component comprises a lightweight structure that comprises a majority of the crown and a portion of the skirt and sole. The lightweight structure may comprise a composite material.

The first component comprises a first material having a first density. The first material can be a metallic material. The first component comprises a first component mass. In some embodiments, the first component can be integrally formed as a single piece, wherein the first component is formed with a single material. Alternately, the first component can receive a separately formed striking face insert that can be secured to the front portion of the club head. The separately formed striking face insert can comprise a metallic material different from the metallic material of the first component. The second component comprises a second material having a second density. The second material can be a non-metallic material. The second component comprises a second component mass.

The first density of the first component can be greater than the second density of the second component. The mass percentage of the first component can range from 80% to 95% of the total mass of golf club head. For example, the mass percentage of the first component can be 80%, 81%, 82%, 83%, 84%, 85%, 86%, 87%, 88%, 89%, 90%, 91%, 92%, 93%, 94%, or 95% of the total mass of the club head. The mass percentage of the second component can range from 5% to 20% of the total mass of golf club head 100. For example, the mass percentage of the second component can be 5%, 6%, 7%, 8%, 9%, 10%, 11%, 12%, 13%, 14%, 15%, 16%, 17%, 18%, 19%, or 20% of the total mass of the golf club head.

As described above, the club head comprises the first component formed from a metallic material. The first component comprises the load bearing structure and the majority of the club head mass. The first component can receive removable weights and/or mass pads to further adjust center of gravity location and moment of inertia. Further, the first component can include ribs to provide structural reinforcement or sound control.

As described above, the club head comprises the second component formed from a non-metallic, lightweight material. The second component comprises a lightweight structure that forms portions of the crown, side walls or skirt, and sole. The second component can reduce the mass of the golf club head and allow additional discretionary mass to be distributed to the first component.

Alternately, the second component can comprise a plurality of separately formed portions, which may be subsequently permanently joined by adhesives, sonic welding, fusion bonding, or other permanent joining methodologies appropriate to the materials used in forming the plurality of separately formed portions. For example, the sole or skirt portion or portions may be formed separately from the same or different materials. The second component portions may then be adhesively joined to form the complete second component. Forming the second component as separate portions can be advantageous for certain materials. For example, forming separate portions can be advantageous when using materials such as bi-directional carbon fiber prepreg materials. Bi-directional carbon fiber prepreg does not easily accommodate small curvatures within the geometry of the second component, where a single piece construction is not easily manufacturable. Using such a material may produce a need to form separate sole portions and that are later joined by adhesives or other methods to form the assembled second component.

In many embodiments, the thickness of the second component can range from 0.025 inch to 0.075 inch. In some embodiments, the thickness of the second component can range from 0.025 inch to 0.05 inch, or 0.05 inch to 0.075 inch. In some embodiments, the thickness of the second component can range from 0.03 inch to 0.06 inch, 0.035 inch to 0.065 inch, 0.045 inch to 0.07 inch, or 0.05 inch to 0.075 inch. For example, the thickness of the second component can be 0.025, 0.03, 0.04, 0.045, 0.05, 0.055, 0.06, 0.07, or 0.075 inch. In one example, the thickness of the second component can range from 0.025 inch to 0.05 inch.

In some embodiments the second component can further comprise ribs, thickened sections, thinned sections, or any combination thereof. As used herein, when referring to ribs or thickened sections, the present disclosure is intending to refer to a portion of the second component that has a varying thickness (measured normal to the outer surface of the component) that is comparatively thicker than a second, non-thickened area of the second component.

Ribs or thickened sections can provide additional strength and/or stiffness to the club head through various mechanisms. First, the thickened ribs/sections may act as a strut/gusset that provides a structural framework for the component. In this manner, the design of the structure itself can promote strength. Additionally, the presence of the thickened section may be used during molding to assist in controlling the direction, speed, and uniformity of the polymer flow. In doing so, the orientation of embedded fibers may be controlled so that any anisotropic parameters of the material, itself, are oriented to support the club head's intended purpose. In this sense, the thickened sections can provide both an engineered structure and an engineered material. Finally, in some embodiments, the first component may include a buttressing feature, such as an upstanding strut that is configured to be affixed to the second component. In such a design, the thickened sections may provide a suitable coupling location as the thickened material may distribute any transmitted loads without the risk of fatiguing or fracturing the comparatively thinner sections.

Lap Joints

The first component comprises a bond surface in the form of a recessed lip. The first component lip extends along a first component perimeter edge, wherein the first component perimeter edge extends along a perimeter of a rearward extension of the strike face.

The recessed lip can be recessed from an outer surface of the club head to accommodate the combined thickness of the overlap between the first component and the second component, and any adhesives used to secure the two components together.

The first component lip comprises a width. The width of the first component lip can be measured as a transverse width from where the first component is recessed with respect to the outer surface to the perimeter edge. In many embodiments, the first component lip width can range from 0.1 inch to 0.3 inch. In some embodiments, the first component lip width can range from 0.1 to 0.2 inch, or 0.2 to 0.3 inch. For example, the first component lip width can be 0.100 inch, 0.125 inch, 0.130 inch, 0.150 inch, 0.175 inch, 0.200 inch, 0.220 inch, 0.225 inch, 0.230 inch, 0.250 inch, 0.275 inch, or 0.300 inch. In one example, the first component lip width can range from 0.125 inch to 0.275 inch.

The first component lip can comprise a thickness measured between the outer surface and the inner surface of the first component lip. In many embodiments, the thickness of the first component lip can range between 0.015 inch and 0.035 inch. In some embodiments, the thickness of the first component lip can range from 0.015 inch to 0.025 inch, or from 0.025 inch to 0.035 inch. For example, the thickness of the first component lip can be 0.015, 0.020, 0.022, 0.023, 0.024, 0.025, 0.026, 0.027, 0.028, 0.029, 0.030, or 0.035 inch. In one example, the thickness of the first component lip can range from 0.015 inch to 0.030 inch. In another example, the thickness of the first component lip can be 0.025 inch.

Composite Materials

The second component comprises a less dense material than the material of the first component. In some embodiments, the second component can comprise a composite formed from polymer resin and reinforcing fiber. The polymer resin can comprise a thermoset or a thermoplastic. The second component composite can be either a filled thermoplastic (FT) or a fiber-reinforced composite (FRC). In some embodiments, the second component can comprise a FT bonded together with a FRC. Filled thermoplastics (FT) are typically injection molded into the desired shape. As the name implies, filled thermoplastics (FT) can comprise a thermoplastic resin and randomly-oriented, non-continuous fibers. In contrast, fiber-reinforced composites (FRCs) are formed from resin-impregnated (prepreg) sheets of continuous fibers. Fiber-reinforced composites (FRCs) can comprise either thermoplastic or thermoset resin.

In embodiments with a thermoplastic resin, the resin can comprise a thermoplastic polyurethane (TPU) or a thermoplastic elastomer (TPE). For example, the resin can comprise polyphenylene sulfide (PPS), polyetheretheretherketone (PEEK), polyimides, polyamides such as PA6 or PA66, polyamide-imides, polyphenylene sulfides (PPS), polycarbonates, engineering polyurethanes, and/or other similar materials. Although strength and weight are the two main properties under consideration for the composite material, a suitable composite material may also exhibit secondary benefits, such as acoustic properties. In some embodiments, PPS and PEEK are desirable because they emit a generally metallic-sounding acoustic response when the club head is impacted.

The reinforcing fiber can comprise carbon fibers (or chopped carbon fibers), glass fibers (or chopped glass fibers), graphine fibers (or chopped graphite fibers), or any other suitable filler material. In other embodiments, the composite material may comprise any reinforcing filler that adds strength, durability, and/or weighting.

The density of the composite material (combined resin and fibers), which forms the second component, can range from about 1.15 g/cc to about 2.02 g/cc. In some embodiments, the composite material density ranges between about 1.20 g/cc and about 1.90 g/cc, about 1.25 g/cc and about 1.85 g/cc, about 1.30 g/cc and about 1.80 g/cc, about 1.40 g/cc and about 1.70 g/cc, about 1.30 g/cc and about 1.40 g/cc, or about 1.40 g/cc to about 1.45 g/cc.

IV. Golf Club Head Structural Features

The driver-type golf club head of the present disclosure comprises a shallow and thin strike face as described above. The driver-type golf club head combines the shallow and thin face feature with other features to provide high MOI and improved center of gravity locations while having an increased ball speed at the same CT value. The driver-type golf club head comprises a body width $W_B$, body depth $D_B$, and body height $H_B$, as defined above. In many embodiments, the body width $W_B$, body depth $D_B$, and body height $H_B$ may not be affected by the simultaneous reduction of the strike face height and strike face thickness. Stated another way, the driver-type club head of the present disclosure can achieve a shallow and thin face without significantly altering the frame of the body to achieve high moment of inertia and improved center of gravity locations. The driver-type club head comprising a shallow and thin face may utilize slight changes in curvatures of the crown, sole, and/or skirt to achieve similar overall body dimensions similar to a driver-type club head lacking a shallow or thin face.

The driver-type golf club head 100 comprises a body width $W_B$, defined above, in a range of 4.8 to 5 inches. The body width $W_B$ provides a larger frame to improve the moment of inertia of the golf club head. The body width $W_B$ is not affected by the simultaneous reduction of the strike face height and strike face thickness.

The driver-type golf club head 100 comprises a body depth $D_B$ in a range of 4.65 to 4.95 inches. The body depth $D_B$ provides a larger frame to help improve the moment of inertia of the golf club head while also providing structure to improve center of gravity location in a low and rearward position. The body depth $D_B$ is not affected by the simultaneous reduction of the strike face height and strike face thickness.

The driver-type golf club head 100 comprises a body height $H_B$ in a range of 2.35 inches to 2.8 inches. In some embodiments, the body height $H_B$ of the club head can be maintained to provide improved moment of inertia and center of gravity locations. In other embodiments, the body height $H_B$ may be slightly reduced to accommodate a shortened strike face without significantly changing the crown and sole curvatures.

The crown apex height $H_{CA}$, as defined above, can range from 2.15 to 2.45 inches. For example, in some embodiments, the crown apex height $H_{CA}$ can range from 2.15 to 2.25 inches, 2.20 to 2.30 inches, 2.25 to 2.35 inches, 2.30 to 2.40 inches, or 2.35 to 2.45 inches.

The crown apex depth $D_{CA}$, as defined above, can range from 0.70 to 0.90 inch. For example, in some embodiments, the crown apex depth $D_{CA}$ can range from 0.70 to 0.75 inch, 0.75 to 0.80 inch, 0.80 to 0.85 inch, or 0.85 to 0.90 inch.

The crown apex angle 20, as defined above, can range from 18 to 23 degrees. For example, in some embodiments, the crown apex angle 20 can range from 18 to 19 degrees, 19 to 20 degrees, 20 to 21 degrees, 21 to 22 degrees, or 22 to 23 degrees.

As mentioned above, in some embodiments, the reduced strike face height may alter the ball launch characteristics such as the ball spin and ball launch angle. The reduction in strike face height, in some embodiments, may change the location of the center of gravity projection point relative to the face center. In some embodiments, the CG projection will be raised relative to the face center 116. To maintain a shortened face height and an improved CG projection point, the driver-type club head can have an increased bottom edge height $H_{BP}$ or an increased sole apex angle 25. By raising the bottom edge point 127 away from the ground plane 1010, the face center 116 will also be raised.

The bottom edge point height $H_{BP}$, as defined above, can range between 0.350 inch and 0.385 inch. For example, the bottom edge point height $H_{BP}$ can range between 0.350 and 0.360 inch, 0.355 and 0.365 inch, 0.360 and 0.370 inch, 0.365 and 0.375 inch, or 0.370 and 0.380 inch. In some embodiments, the bottom edge point height $H_{BP}$ can be about 0.350 inch, 0.352 inch, 0.354 inch, 0.356 inch, 0.358 inch, 0.360 inch, 0.362 inch, 0.364 inch, 0.366 inch, 0.368 inch, 0.370 inch, 0.372 inch, 0.374 inch, 0.376 inch, 0.378 inch, 0.380 inch. In the illustrated embodiment, the bottom edge point height $H_{BP}$ is about 0.367 inch. The bottom edge point height can be selected to provide a desired location of the face center 116 without altering the strike face height $H_{FC}$ and strike face thickness $T_{SF}$ so that the driver-type club head may have improved ball speed and launch characteristics while maintaining a conforming CT value.

The sole apex depth $D_{SA}$, as defined above, can range between 0.60 and 0.67 inch. For example, in some embodiments, the sole apex depth $D_{SA}$ can range between 0.60 and 0.61, between 0.61 and 0.62 inch, 0.62 and 0.63 inch, 0.63 inch and 0.64 inch, 0.64 and 0.65 inch, 0.65 and 0.66 inch, or 0.66 and 0.67 inch. In the illustrated embodiment, the sole apex depth $D_{SA}$ is about 0.62 inch.

The sole apex angle 25, as defined above, can range between 27 and 32 degrees. For example, the sole apex angle can range between 27 and 28 degrees, 28 and 29 degrees, 29 and 30 degrees, 30 and 31 degrees, or 31 and 32 degrees. In the illustrated embodiment, the sole apex angle 25 is about 30.8 degrees.

The driver-type golf club head 100 comprises a club head volume and a club head mass. In one embodiment the club head volume is not equal to or less than 400 cc. In one embodiment, the club head volume is greater than 400 cc. In one embodiment, the club head volume is in a range of 401 cc to 500 cc. In one embodiment, the club head volume may be in a range of 420 cc to 460 cc. In one embodiment, the club head volume may be in a range of 440 cc to 460 cc. In one embodiment, the club head volume may be in a range of 440 cc to 480 cc. In one embodiment, the club head mass is equal to or less than 360 grams. In one embodiment, the club head mass is greater than 290 grams. In one embodiment, the club head mass may be in a range of 290 grams to 360 grams.

In some embodiments, the driver-type golf club head 100 can further comprise a removeable and adjustable weight system located at a rear sole and rear skirt position. The removeable and adjustable weight system comprises a weight receiving channel having at least three discrete weight attachment points, and a removable weight having a mass in a range of 5 grams to 50 grams. In other embodiments, the driver-type golf club head 100 can further comprise a single position weight wherein a removable weight is attached at one location and a single location on the golf club head. The removable weight can have a mass in a range of 15 grams to 50 grams.

In some embodiments, the driver-type golf club head 100 comprises a top opening configured to receive a lightweight upper insert. When the top opening receives the lightweight upper insert, the upper insert comprises a portion of the golf club head crown, a portion of the toeward skirt or sidewall, a portion of the heelward skirt or sidewall, and a portion of the rearward skirt or sidewall. The upper insert toeward and heelward portions may further comprise a portion of the golf club head sole. The upper insert may be a unitary insert, which may comprise a plurality of pieces joined to form the upper insert, wherein all of the upper insert comprises the same, lightweight material. The upper insert can be made from a lightweight material such as polymeric materials, composites, or other similar materials.

In some embodiments, the driver-type golf club head 100 comprises an internal hosel structure configured to receive a golf shaft lower end, or a golf shaft adjustment system attached to a golf shaft lower end, such that a gap is present in the internal hosel structure. The internal hosel structure comprises an internal hosel upper portion proximate an upper hosel opening, and an internal hosel lower portion proximate the sole that are not connected to one another and define a gap between the internal hosel upper portion and the internal hosel lower portion. The internal hosel structure gap is configured so that some or all of the received golf shaft lower end or the golf shaft adjustment system attached to a golf shaft lower end is exposed within the internal volume of the golf club head 100, but not exposed to an exterior surface.

The driver-type club head can comprise an Ixx, as defined above, ranging from approximately 3600 $g*cm^2$ to 4500 $g*cm^2$. For example, in some embodiments, the driver-type club head comprises an Ixx greater than 3600 $g*cm^2$, greater than 3700 $g*cm^2$, greater than 3800 $g*cm^2$, greater than 3900 $g*cm^2$, greater than 4000 $g*cm^2$, greater than 4100 $g*cm^2$, or greater than 4200 $g*cm^2$.

The driver-type club head can comprise an Iyy, as defined above, ranging from approximately 5000 $g*cm^2$ to 6000 g*cm$^2$. The Iyy can be greater than 5000 g*cm$^2$, greater than 5100 g*cm$^2$, greater than 5200 g*cm$^2$, greater than 5300 g*cm$^2$, greater than 5400 g*cm$^2$, greater than 5500 g*cm$^2$, or greater than 5600 g*cm$^2$. The Iyy can range between 5000 g*cm$^2$ and 5250 g*cm$^2$, 5100 g*cm$^2$ and 5350 g*cm$^2$, or between 5200 g*cm$^2$ and 5450 g*cm$^2$.

The driver-type club head can comprise an Izz, as defined above, ranging from approximately 2500 and 2900 g*cm$^2$. The Izz can range between 2500 g*cm$^2$ and 2600 g*cm$^2$, 2600 g*cm$^2$ and 2700 g*cm$^2$, 2700 g*cm$^2$ and 2800 g*cm$^2$, or 2800 g*cm$^2$ and 2900 g*cm$^2$.

The driver-type club head can comprise a CGy, as defined above, ranging from −0.30 to 0.00 inch. For example, in some embodiments, the CGy can range from −0.30 to −0.20 inch, −0.20 to −0.10 inch, or −0.10 to 0.00 inch.

The driver-type club head can comprise a CGx, as defined above, ranging from −0.10 to 0.20 inch. For example, the CGx can range between −0.10 to −0.05 inch, −0.05 to 0.00 inch, 0.00 to 0.10 inch, or 0.10 to 0.20 inch.

The driver-type club head can comprise a CGz, as defined above, ranging from −1.5 to −2.0 inches. For example, in some embodiments, the CGz can range between −1.5 to −1.6 inches, −1.6 to −1.7 inches, −1.7 to −1.8 inches, −1.8 to −1.9 inches, or −1.9 to −2.0 inches.

The driver-type club head can comprise a $Y_{GP}$, as defined above, ranging from 0.90 and 1 inch. For example, the $Y_{GP}$ can be about 0.90 inch, 0.91 inch, 0.92 inch, 0.93 inch, 0.94 inch, 0.95 inch, 0.96 inch, 0.97 inch, 0.98 inch, 0.99 inch, or 1.00 inch.

V. Relationship Equations

The disclosed golf club head carefully balances various structural relationships. Each structural decision is made in relation to the requirements of other structures within the golf club. The relationships listed below are reflective of the large number of synergistic structural decisions needed to achieve the ball speed increase while remaining within the constraints of CT regulatory requirements and desirable mass properties.

Relationship 1 (Face Insert volume vs Club Head volume)

$$0.011 \le \frac{FIv}{Cv} \le 0.015$$

Relationship 2 (Face Insert as vs Club Head mass)

$$0.09 \le \frac{FIm}{Cm} \le 0.12$$

Relationship 3 ($CG_Y$ vs Face Insert Height)

$$0.1 \le \frac{|CGy|}{FIh} \le 5$$

Relationships 4A and 4B (CG positions vs Face Insert mass) (in/gram)

$$0.005 \le \frac{|CGy|}{FIm} \le 05$$

$$0.1 \le \frac{|CGz|}{FIm} \le 0.9$$

Relationships 5A and 5B (CG positions vs Face Insert Volume) (in$^{-2}$)

$$0.1 \le \frac{|CGy|}{FIv} \le 1$$

$$3 \le \frac{|CGz|}{FIv} \le 7$$

Figure 13:
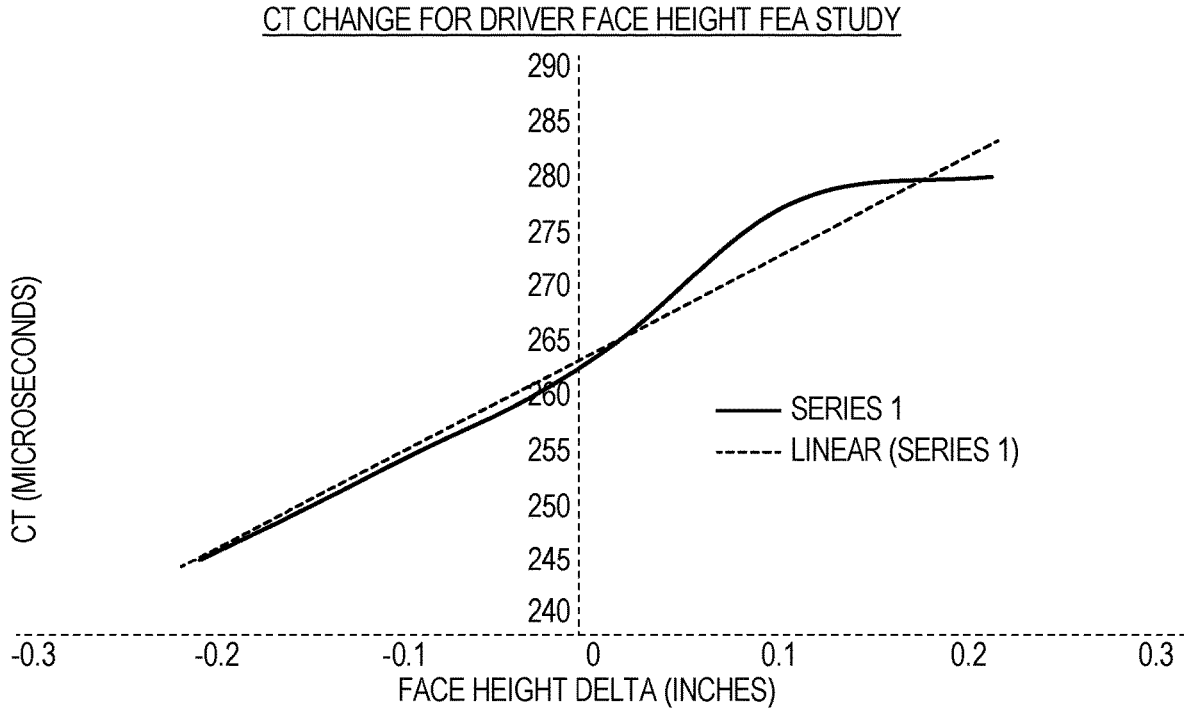
FIG. 13 illustrates a chart comparing face height and CT.

Relationship 6 (See FIG. 13) CT Change for Driver Face Height $$y=92.52x+264.31$$

Where y is CT in microseconds and x is Face Height Delta (inches).

Relationship 7 (Face Height vs Face Thickness)

$$16 \le \frac{Hsf}{Tsf} \le 22$$

Figure 15:
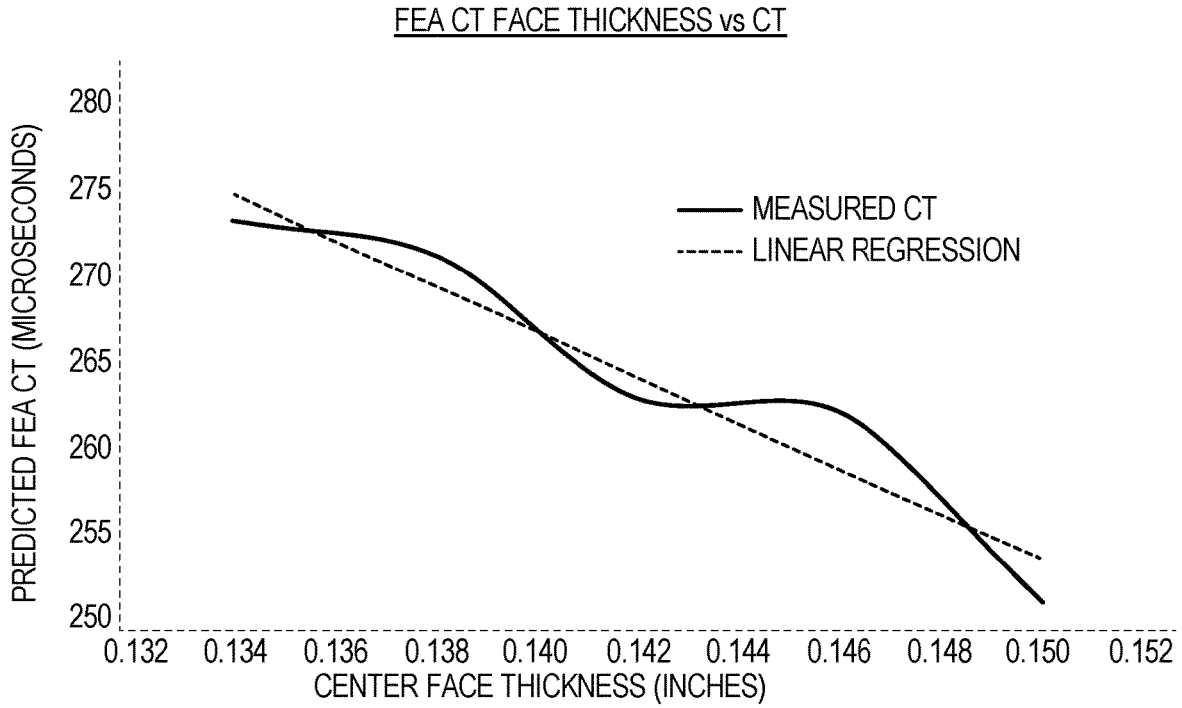
FIG. 15 illustrates a chart comparing face thickness and CT.

Relationship 8—See FIG. 15 (Average Face Thickness vs. CT)

$$y=-1319x+451.6$$

Where y is predicted CT in microseconds and x is face thickness in inches.

Figure 14:
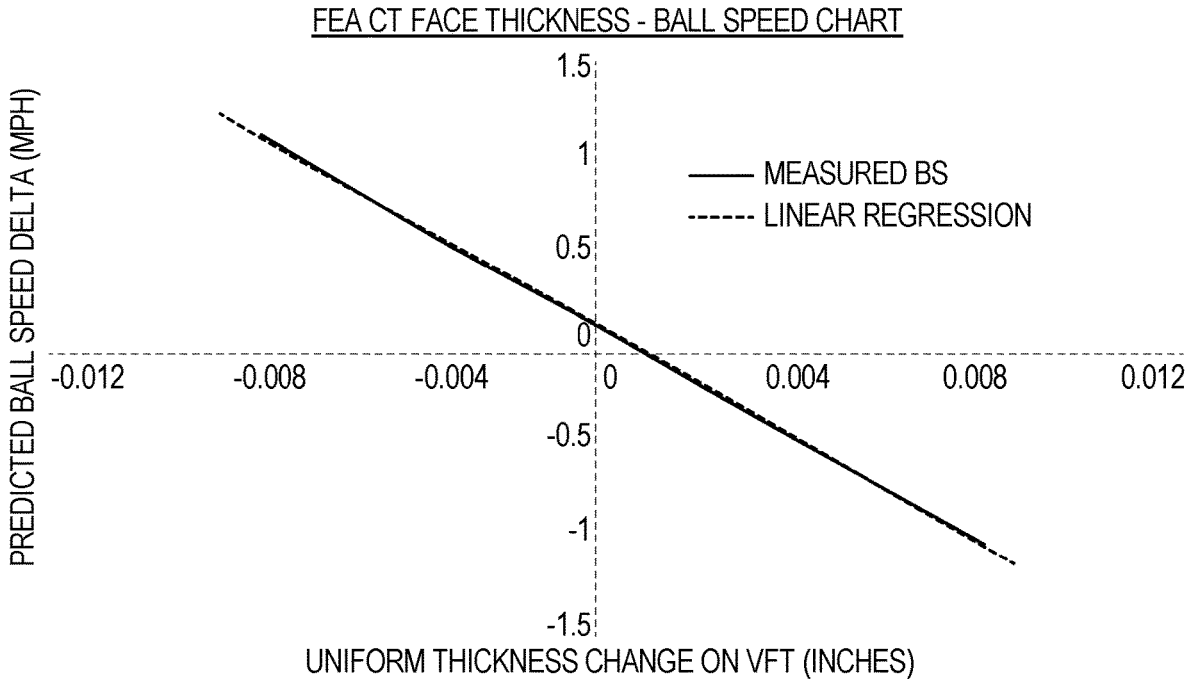
FIG. 14 illustrates a chart comparing face thickness and ball speed.

Relationship 9—See FIG. 14 (Face Thickness vs Ball Speed)

$$y=-134x+0.002$$

Where y is ball speed in mph and x is the uniform face thickness across entire strike face.

Figure 12:
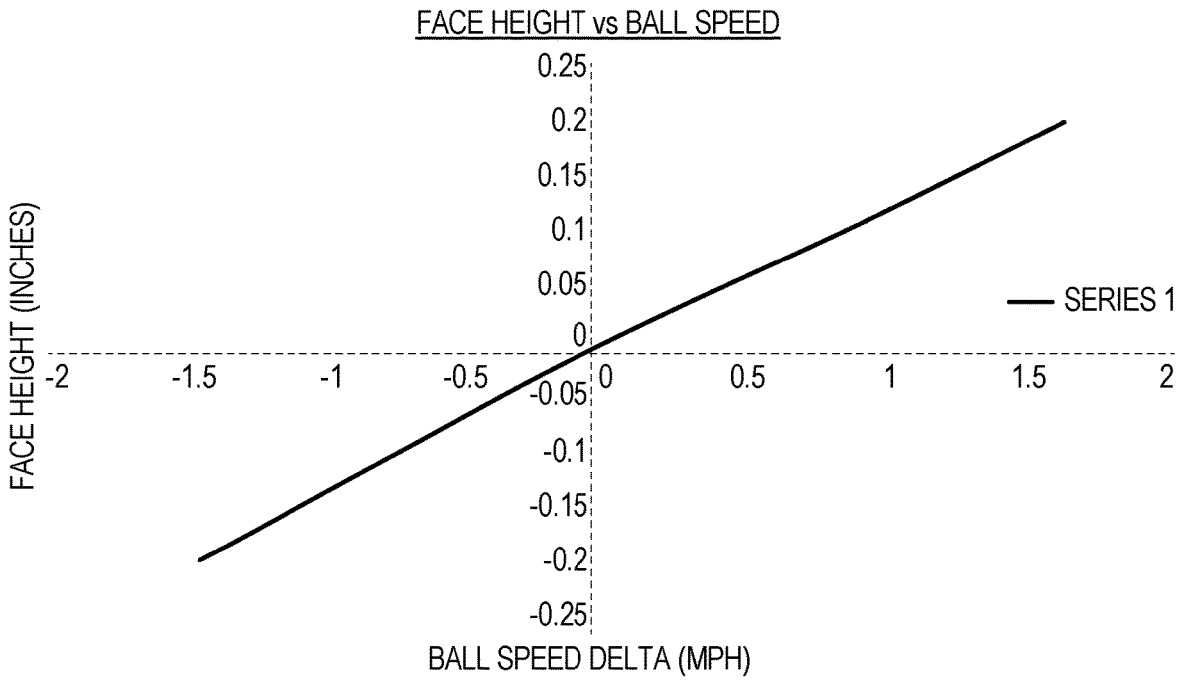
FIG. 12 illustrates a chart comparing face height and ball speed.

Relationship 10—See FIG. 12 (Change in Face Height vs Change in Ball Speed) (cm/mph)

$$0.1 \le \frac{\Delta Fh}{\Delta \text{ Ball Speed}} \le 10.0$$

Relationship 11

$$0.65 \le \frac{HSF}{HCA} \le 0.73$$

Relationship 12 (Face Height vs. Top Point Height)

$$0.75 \le \frac{HSF}{HTP} \le 0.82$$

Relationship 13 (Face Height vs. Bottom Point Height)

$$4.0 \le \frac{HSF}{HBP} \le 4.7$$

Relationship 14 (Face Height vs. Crown Apex Depth)

$$1.9 \le \frac{HSF}{DCA} \le 2.1$$

Relationship 15 (Face Height vs. CG Height above the Ground Plane)

$$1.5 \leq \frac{HSF}{YGP} \leq 1.8$$

Relationship 16 (Face Height vs. Club Head Depth)

$$0.30 \leq \frac{HSF}{DB} \leq 0.37$$

Relationship 17 (Face Height vs. Club Head Width)

$$0.29 \leq \frac{HSF}{WB} \leq 0.36$$

Relationship 18 (Face Height vs. Average Strike Face Thickness)

$$16.36 \leq \frac{HSF}{TSF} \leq 16.48$$

Relationship 19 (Face Height vs. Maximum Strike Face Thickness)

$$12.8 \leq \frac{HSF}{TSF(\text{Max})} \leq 14.1$$

Relationship 20 (Face Height vs. Strike Face Perimeter Length)

$$0.17 \leq \frac{HSF}{PerimeterLengthSF} \leq 0.21$$

Relationship 21 (Face Height vs. Strike Face Width)

$$0.40 \leq \frac{HSF}{WSF} \leq 0.47$$

Relationship 21 (Crown Apex Angle to Sole Apex Angle Ratio)

$$0.66 \leq \frac{CrownApexAngle}{SoleApexAngle} \leq 0.72$$

Relationship 22 (Top Point Height vs. Bottom Point Height)

$$5.28 \leq \frac{HTP}{HBP} \leq 5.72$$

Relationship 23 (Strike Face Area vs. Strike Face Perimeter Length)

$$0.49 \text{ inch} \leq \frac{AreaSF}{PerimeterLengthSF} \leq 0.56 \text{ inch}$$

Relationship 24 (Club Head Depth vs. Club Head Width)

$$0.96 \leq \frac{DB}{WB} \leq 0.99$$

Relationship 25 (Club Head Body Height vs. CG Height Above Ground Plane)

$$2.3 \leq \frac{HB}{YGP} \leq 2.8$$

Relationship 26 (Face Center Height vs. Height of Bottom Point)

$$3.14 \leq \frac{HFC}{HBP} \leq 3.38$$

EXAMPLES

Example 1: Relationship Between Face Thickness to CT and Ball Speed

Example 1 illustrates the relationship between face thickness to CT and ball speed. As illustrated in the charts in FIGS. 14 and 15, face thickness affects the CT by 9.24 microseconds per 0.0075" change in face thickness and affects the ball speed by 1 mph per 0.0075" change in face thickness.

Example 2: Relationship Between Face Height to CT and Ball Speed

Example 2 illustrates the relationship between face height to CT and ball speed. As illustrated in the charts in FIGS. 13 and 14, face height affects the CT by 7.66 microseconds per 0.100" change in face height and affects the ball speed by 0.8 mph per 0.100" change in face height.

Example 3: FEA Exemplary vs. Control

Example 3 compares an exemplary driver-type golf club head according to aspects of the present invention to a control club head. This comparative example was conducted to illustrate the benefits and improvements of the exemplary driver-type golf club head exhibited over the control club head. The exemplary driver-type golf club head and the control driver-type golf club head were identical in all aspects except for two key characteristics. Firstly, the exemplary club head comprised a shorter face height than the control club head. Secondly, the exemplary club head comprised a thinner face thickness than the control club head. Specifically, the exemplary club head comprised a face height of 1.733 inches and the control club head comprised a face height of approximately 1.820 inches.

Further, the exemplary driver-type golf club head comprised a face thickness that was 0.008 inches less than the face thickness of the control club head when measured at any corresponding point on the strike face. The exemplary driver-type golf club head comprises the exact same VFT geometries/structure as the control driver-type golf club head. The VFT structures comprised a thickened middle portion which tapers to a thinner perimeter region. The VFT structures of both the exemplary club head and control club head are identical, except for the thicknesses. The exemplary driver-type golf club head comprises the same VFT structure but the thickness value reduced uniformly by 0.080 inches.

The data was collected using Finite Element Analysis (FEA) through Computer Aided Design software (CAD). The data collected was ball speed and CT. The exemplary driver-type golf club head exhibited a 0.7 MPH increase in ball speed over the control club head. The exemplary club head exhibited a CT value of 270 microseconds while the control club head exhibited a CT value of 269 microseconds. As such, reducing the face height and thinning the face, the exemplary driver-type club head was able to produce more ball speed than the control driver-type club head while maintaining the same, conforming CT value.

Example 4: Club Head Feature Comparison

Example 4 compares two exemplary club heads having a short and thin strike faces to a control club head having a larger and thicker strike face.

TABLE 2

| | Exemplary 1 | Exemplary 2 | Control |
|---|---|---|---|
| Strike Face Perimeter Length | 8.386 inches | 8.710 inches | 8.810 inches |
| Top Edge Point Height ($H_{TP}$) | 1.97 inches | 2.087 inches | 2.191 inches |
| Face Center Height ($H_{FC}$) | 1.173 inches | 1.236 inches | 1.299 inches |
| Bottom Edge Point Height ($H_{BP}$) | 0.367 inch | 0.374 inch | 0.396 inch |

Table 1 illustrates the strike face perimeter length, top edge point height $H_{TP}$, face center height $H_{FC}$, and bottom edge point height $H_{BP}$. The two exemplary embodiments having a strike face perimeter length of 8.386 inches and 8.710 inches while the control club head had a strike face perimeter length of 8.810 length. The shortened strike face height reduced the strike face perimeter length.

The two exemplary embodiments had a top edge point height of 1.97 inches and 2.087 inches while the control club head has a top edge point height of 2.191 inches. The shortened strike face height reduced the top edge point height.

The two exemplary embodiments had a face center height of 1.173 inches and 1.236 inches while the control club head had a face center height of 1.299 inches. The shortened strike face height reduced the face center height.

The two exemplary embodiments had a bottom edge point height of 0.367 inch and 0.374 inch while the control club head had a bottom edge point height of 0.396 inch. The shortened strike face height reduced the bottom edge point height.

The shortened strike face heights of the exemplary embodiments imparted changes to the overall shaping features described above.

Example 5: Face Height and Face Thickness vs. Normalized Ball Speed

Example 5 is an example comparing two exemplary driver-type golf club heads comprising a shortened and thinner strike face to a control club head comprising a thicker and taller strike face. The data was collected via two Player Tests using physical club heads. The first player test compared exemplary club 1 to exemplary club 2. The second player test compared exemplary club 2 to the control club. The data was normalized to provide a three club comparison, where normalized ball speed indicated the relative ball speed difference between each club.

TABLE 2

| | Exemplary 1 | Exemplary 2 | Control |
|---|---|---|---|
| Face height ($H_{SF}$) | 1.622 inches | 1.733 inches | 1.818 inch |
| Max Face Thickness | 0.120 inches | 0.134 inches | 0.142 inch |
| Min Face Thickness | 0.80 inches | 0.84 inches | 0.92 inch |
| Average Face Thickness ($T_{SF}$) | 0.094 inch | 0.099 inch | 0.109 inch |
| CT | 237 microseconds | 237 microseconds | 237 microseconds |
| Normalized Ball Speed | +1.2 mph | +0.7 mph | 0 mph |

As illustrated in Table 2, the exemplary club 1 exhibited the highest normalized ball speed. The exemplary club 1 had a normalized ball speed of +1.2 mph compared to the control club head. As such, the exemplary club head 1 demonstrated an average of a 1.2 mph increase in ball speed over the control club head. For example, if a player produced a 120 mph ball speed with the control club head, the same player would produce a 121.2 mph ball speed with exemplary club head 1.

Similarly, the exemplary club 2 exhibited the second highest normalized ball speed. Exemplary club 2 exhibited a normalized ball speed of +0.7 mph compared to the control club head. As such, exemplary club 2 demonstrated an average of a 0.7 mph increase in ball speed over the control club head. For example, if a player produces a 120 mph ball speed with the control club head, the same player would produce a 120.7 mph ball speed with exemplary club head 2.

Therefore, the exemplary club heads comprising a shorter face height and reduced face thickness demonstrated an increase in ball speed when compared to a control club head comprising a taller and thicker face. Furthermore, the exemplary club heads maintained a conforming CT value of 237 microseconds.

Example 6: MOI Comparison

Example 6 compared the Moment of Inertia values between two exemplary club heads comprising shallow and thin faces to a control club head comprising a larger and thicker strike face.

As illustrated in Table 3, each of exemplary club heads 1 and 2 had a higher Iyy moment of inertia than the control club head. Exemplary club 1 also had a higher Ixx than the control club head. A higher moment of inertia value produces a more forgiving club head to improve off center hits. The exemplary club heads comprising shallow and thin faces achieved higher moments of inertia due to the mass saved from the smaller faces. The mass saved by reducing the face height was allocated to other location in the club head body to improve perimeter weighting which increased the moment of inertia value.

TABLE 3

| | Exemplary 1 | Exemplary 2 | Control |
|---|---|---|---|
| Ixx | 675 g*in$^2$ | 654 g*in$^2$ | 662 g*in$^2$ |
| Iyy | 883 g*in$^2$ | 880.9 g*in$^2$ | 876.5 g*in$^2$ |

CLAUSES

Clause 1: A driver-type golf club head comprising; a club head body comprising: a crown, a front end, a rear end opposite the front end, a toe end, a heel end opposite the toe end, a sole opposite the crown, and a skirt forming the transition surface between the crown and the sole other than on the front end, each having an inner and outer surface, and a strike face located on the front end comprising a geometric center; a body width, a body depth, and a body height; and a body center of gravity; wherein: a loft plane is defined tangent to the geometric center; a ground plane is defined tangent to the sole when the club head body is in an address position; a loft angle is defined by the loft plane and the ground plane; wherein the loft angle is in a range of 7.0 degrees to 16 degrees; an x-axis is defined through the geometric center in a toe portion to heel portion direction parallel to the ground plane; a y-axis is defined through the geometric center in a crown to sole direction perpendicular to the x-axis; a z-axis is defined through the geometric in a front end to rear end direction perpendicular to both the x-axis and to the y-axis; a y'-axis is defined through the center of gravity in a crown to sole direction parallel to the y-axis; an Iyy is measured as the moment of inertia about the y'-axis, and the Iyy ranges from about 4900 g*cm2 to 5900 g*cm2; the body width is measured between a heelward-most point and a toeward-most point parallel to the x-axis, and the body width is between 4.6 inches and 5 inches; the body depth is measured between a leading edge and a rearward-most point parallel to the z-axis, and the body depth is between 4.5 and 4.95 inches; the body height is measured between the ground plane and a highest point on the crown; and the body height is between about 2.3 and 2.8 inches; a volume of the club head body is greater than about 440 cm3; a YGP is measured from the body center of gravity to the ground plane, parallel to the y-axis, and the YGP is between about 0.8 inch and 1.0 inch; a CGz is measured from the geometric center to the body center of gravity, parallel to the z-axis, the CGz is between about 1.60 and 1.85 inches; the strike face is defined by a bulge curvature and a roll curvature; the bulge curvature is the curvature of the strike face in a heel-to-toe direction and the roll curvature is the curvature of the strike face in a crown-to-sole direction; the bulge curvature comprises a bulge radius and the roll curvature comprises a roll radius; the strike face comprises a strike face perimeter defined at the point where the bulge radius and roll radius deviate from the bulge curvature and roll curvature respectively; the strike face perimeter comprises a top edge, a bottom edge, a toe edge, and a heel edge; the strike face perimeter comprises a top edge point defined by the intersection of the top edge and a YZ plane defined by the y-axis and z-axis; the strike face perimeter comprises a bottom edge point defined by the intersection of the bottom edge of the strike face perimeter and the YZ plane; the strike face perimeter comprises a strike face length between 8.15 inches and 8.90 inches; the strike face comprises a strike face height, measured between the top edge point and the bottom edge point parallel to the loft plane, and the strike face height is between about 1.40 inches and 1.80 inches; the strike face comprises a strike face volume, measured as the volume bounded by a strike face front surface, a strike face rear surface, and the strike face perimeter projected perpendicular to the loft plane, and the strike face volume is between about 0.410 in3 and 0.500 in3; the strike face comprises an area, measured as the area of the strike face front surface bounded by the strike face perimeter, and the strike face area is between about 4.0 and 5.0 in2; the strike face comprises a thickness measured as the strike face volume divided by the strike face area, the strike face thickness is between about 0.085 and 0.100 inch; the strike face comprises a strike face width measured as the distance between a heelmost-point of the strike face perimeter to a toeward-most point of the strike face perimeter parallel to the x-axis, and the strike face width is between about 3.5 inches and 4.5 inches; the strike face comprises a top edge point height, measured between the top edge point and the ground plane and parallel to the y-axis, and the top edge point height is between about 1.85 inch and 2.20 inch; the strike face comprises a bottom edge point height, measured between the bottom edge point and the ground plane and parallel to the y-axis, and the bottom edge point height is between about 0.350 inch and 0.385 inch; the strike face comprises a face center height measured between the geometric center and the ground plane and parallel to the y-axis, and the face center height ranges from 1.10 to 1.30 inches; the club head body comprises a crown apex point located at a highest point on the crown in the YZ plane, the crown apex point comprises a height between about 2.15 inches and 2.45 inches measured between the crown apex point and the ground plane parallel to the y-axis; the crown apex point comprises a depth measured between the top edge point and the crown apex point parallel to the z-axis, and the crown apex point depth is between about 0.70 and 0.90 inch; the club head comprises a crown apex angle measured between a first imaginary line parallel to the z-axis and a second imaginary line which intersects both the crown apex point and the top edge point, and the crown apex angle ranges between 18 degrees and 23 degrees; the club head body comprises a sole apex point located at a lowest point on the sole in the YZ plane; the sole apex point comprises a depth measured from the bottom edge point to the sole apex point and parallel to the z-axis, and the sole apex point depth ranges from 0.60 to 0.67 inch; the club head body comprises a sole apex angle measured between a third imaginary line parallel to the z-axis and a fourth imaginary line which intersects both the sole apex point and the bottom edge point, and the sole apex angle ranges between 27 degrees and 32 degrees.

Clause 2: The driver-type golf club head of clause 1, wherein the strike face comprises a strike face width measured as the distance between a heelmost-point of the strike face perimeter to a toeward-most point of the strike face perimeter parallel to the x-axis, and the strike face width is between about 3.5 inches and 4.5 inches. Clause 3: The driver-type golf club head of clause 2, wherein the strike face comprises a top edge point height, measured between the top edge point and the ground plane and parallel to the y-axis, and the top edge point height is between about 1.85 inches and 2.20 inches.

Clause 4: The driver-type golf club head of clause 3, wherein the strike face comprises a bottom edge point height, measured between the bottom edge point and the ground plane and parallel to the y-axis, and the bottom edge point height is between about 0.350 inch and 0.385 inch.

Clause 5: The driver-type golf club head of clause 4, wherein the strike face comprises a face center height measured between the geometric center and the ground plane and parallel to the y-axis, and the face center height ranges from 1.10 to 1.30 inches.

Clause 6: The driver-type golf club head of clause 1, wherein the club head body comprises a crown apex point located at a highest point on the crown in the YZ plane, the crown apex point comprises a height between about 2.15 inches and 2.45 inches measured between the crown apex point and the ground plane parallel to the y-axis.

Clause 7: The driver-type golf club head of clause 6, wherein the crown apex point comprises a depth measured between the top edge point and the crown apex point parallel to the z-axis, and the crown apex point depth is between about 0.70 and 0.90 inch.

Clause 8: The driver-type golf club head of clause 7, wherein the club head comprises a crown apex angle measured between a first imaginary line parallel to the z-axis and a second imaginary line, which intersects both the crown apex point and the top edge point, and the crown apex angle ranges between 18 degrees and 23 degrees.

Clause 9: The driver-type golf club head of clause 8, wherein the club head body comprises a sole apex point located at a lowest point on the sole in the YZ plane; the sole apex point comprises a depth measured from the bottom edge point to the sole apex point and parallel to the z-axis, and the sole apex point depth ranges from 0.60 to 0.67 inch.

Clause 10: The driver-type golf club head of clause 9, wherein the club head body comprises a sole apex angle measured between a third imaginary line parallel to the z-axis and a fourth imaginary line, which intersects both the sole apex point and the bottom edge point, and the sole apex angle ranges between 27 degrees and 32 degrees.

Clause 11: A driver-type golf club head comprising a club head body comprising: a crown, a front end, a rear end opposite the front end, a toe end, a heel end opposite the toe end, a sole opposite the crown, and a skirt forming the transition surface between the crown and the sole other than on the front end, each having an inner and outer surface, and a strike face located on the front end comprising a geometric center; a body width, a body depth, and a body height; and a body center of gravity; a face insert and a front opening configured to receive the face insert; wherein: a loft plane is defined tangent to the geometric center; a ground plane is defined tangent to the sole when the club head body is in an address position; a loft angle is defined by the loft plane and the ground plane; wherein the loft angle is in a range of 7.0 degrees to 16 degrees; an x-axis is defined through the geometric center in a toe portion to heel portion direction parallel to the ground plane; a y-axis is defined through the geometric center in a crown to sole direction perpendicular to the x-axis; a z-axis is defined through the geometric in a front end to rear end direction perpendicular to both the x-axis and to the y-axis; a y'-axis is defined through the center of gravity in a crown to sole direction parallel to the y-axis; an Iyy is measured as the moment of inertia about the y'-axis, and the Iyy ranges from about 4900 g*cm2 to 5900 g*cm2; the body width is measured between a heelward-most point and a toeward-most point parallel to the x-axis, and the body width is between 4.6 inches and 5 inches; the body depth is measured between a leading edge and a rearward-most point parallel to the z-axis, and the body depth is between 4.5 and 4.95 inches; the body height is measured between the ground plane and a highest point on the crown; and the body height is between about 2.3 and 2.8 inches; a volume of the club head body is greater than about 440 cm3; a YGP is measured from the body center of gravity to the ground plane, parallel to the y-axis, and the YGP is between about 0.8 inch and 1.0 inch; a CGz is measured from the geometric center to the body center of gravity, parallel to the z-axis, the CGz is between about 1.60 and 1.85 inches; the face insert comprises a face insert perimeter, a front surface which forms at least a portion of the strike face, and a rear surface; the face insert perimeter comprises a top edge and a bottom edge; the face insert comprises a top edge point defined by the intersection of the top edge of the face insert perimeter and the YZ plane; the face insert perimeter comprises a bottom edge point defined by the intersection of the bottom edge of the face insert perimeter and the YZ plane; the face insert perimeter comprises a face insert perimeter length between 7.30 inches and 8.10 inches; the face insert comprises a face insert height, measured between the top edge point and the bottom edge point parallel to the loft plane, and the face insert height is between about 1.35 inches and 1.70 inches; the face insert comprises a face insert volume, measured as the volume bounded by the face insert front surface, the face insert rear surface, and the face insert perimeter projected perpendicular to the loft plane, and the face insert volume is between about 0.244 in3 and 0.400 in3; the face insert comprises an area, measured as the area of the face insert front surface bounded by the face insert perimeter, and the face insert area is between about 3.0 in2 and 4.30 in2; and the face insert comprises a thickness measured as the face insert volume divided by the face insert front area, the face insert thickness is between about 0.085 and 0.110 inch.

Clause 12: The golf club head of clause 11, wherein the face insert height is between about 1.45 inches and 1.52 inches.

Clause 13: The golf club head of clause 12, wherein the face insert thickness is between about 0.094 inch and 0.098 inch.

Clause 14: The golf club head of clause 13, wherein the face insert comprises a mass ranging from about 22 to 28 grams.

Clause 15: The golf club head of clause 11, wherein the face insert area is less than a strike face area, the strike face area is defined by a bulge and roll curvature profile.

Clause 16: The golf club head of clause 15, wherein the club head comprises a removably attached weight; the removably attached weight comprises a mass ranging from 18 to 38 grams.

Clause 17: The golf club head of clause 16, wherein the face insert is welded to the front opening.

Clause 18: The golf club head of clause 11, wherein the face insert comprises a VFT profile on the face insert rear surface.

Clause 19: The golf club head of clause 18, wherein the strike face insert is made from a material having a density between 50 g/in3 to 100 g/in3.

Clause 20: The golf club head of clause 19, wherein a thickness at the geometric center is less than 0.125 inch.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to ocm3ur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A driver-type golf club head comprising:

a club head body comprising:

a crown, a front end, a rear end opposite the front end, a toe end, a heel end opposite the toe end, a sole opposite the crown, and a skirt forming a transition surface between the crown and the sole other than on the front end, each having an inner and outer surface, and a strike face located on the front end comprising a geometric center;

a body width, a body depth, and a body height; and a body center of gravity;

wherein:

a loft plane is defined tangent to the geometric center;

a ground plane is defined tangent to the sole when the club head body is in an address position;

a loft angle is defined by the loft plane and the ground plane;

wherein the loft angle is in a range of 7.0 degrees to 16 degrees;

an x-axis is defined through the geometric center in a toe portion to heel portion direction parallel to the ground plane;

a y-axis is defined through the geometric center in a crown to sole direction perpendicular to the x-axis;

a z-axis is defined through the geometric in a front end to rear end direction perpendicular to both the x-axis and to the y-axis;

a y'-axis is defined through the center of gravity in a crown to sole direction parallel to the y-axis;

an Iyy is measured as the moment of inertia about the y'-axis, and the Iyy ranges from about 4900 g*cm$^2$ to 5900 g*cm$^2$;

the body width is measured between a heelward-most point and a toeward-most point parallel to the x-axis, and the body width is between 4.6 inches and 5 inches;

the body depth is measured between a leading edge and a rearward-most point parallel to the z-axis, and the body depth is between 4.5 and 4.95 inches;

the body height is measured between the ground plane and a highest point on the crown; and the body height is between about 2.3 and 2.8 inches;

a volume of the club head body is greater than about 440 cm$^3$;

a $Y_{GP}$ is measured from the body center of gravity to the ground plane, parallel to the y-axis, and the $Y_{GP}$ is between about 0.8 inch and 1.0 inch;

a CGz is measured from the geometric center to the body center of gravity, parallel to the z-axis, the CGz is between about 1.60 and 1.85 inches;

the strike face is defined by a bulge curvature and a roll curvature;

the bulge curvature is the curvature of the strike face in a heel-to-toe direction and the roll curvature is the curvature of the strike face in a crown-to-sole direction;

the bulge curvature comprises a bulge radius and the roll curvature comprises a roll radius;

the strike face comprises a strike face perimeter defined at the point where the bulge radius and roll radius deviate from the bulge curvature and roll curvature respectively;

the strike face perimeter comprises a top edge, a bottom edge, a toe edge, and a heel edge;

the strike face perimeter comprises a top edge point defined by the intersection of the top edge and a YZ plane defined by the y-axis and z-axis;

the strike face perimeter comprises a bottom edge point defined by the intersection of the bottom edge of the strike face perimeter and the YZ plane;

the strike face perimeter comprises a strike face perimeter length between 8.15 inches and 8.90 inches;

the strike face comprises a strike face height, measured between the top edge point and the bottom edge point parallel to the loft plane, and the strike face height is between about 1.40 inches and 1.80 inches;

the strike face comprises a strike face volume, measured as the volume bounded by a strike face front surface, a strike face rear surface, and the strike face perimeter projected perpendicular to the loft plane, and the strike face volume is between about 0.410 in$^3$ and 0.500 in$^3$;

the strike face comprises a strike face area, measured as the area of the strike face front surface bounded by the strike face perimeter, and the strike face area is between about 4.0 and 5.0 in$^2$; and the strike face comprises a strike face thickness measured as the strike face volume divided by the strike face area, the strike face thickness is between about 0.085 and 0.100 inch.

2. The driver-type golf club head of claim 1, wherein the strike face comprises a strike face width measured as the distance between a heelmost-point of the strike face perimeter to a toeward-most point of the strike face perimeter parallel to the x-axis, and the strike face width is between about 3.5 inches and 4.5 inches.

3. The driver-type golf club head of claim 2, wherein the strike face comprises a top edge point height, measured between the top edge point and the ground plane and parallel to the y-axis, and the top edge point height is between about 1.85 inches and 2.20 inches.

4. The driver-type golf club head of claim 3, wherein the strike face comprises a bottom edge point height, measured between the bottom edge point and the ground plane and parallel to the y-axis, and the bottom edge point height is between about 0.350 inch and 0.385 inch.

5. The driver-type golf club head of claim 4, wherein the strike face comprises a face center height measured between the geometric center and the ground plane and parallel to the y-axis, and the face center height ranges from 1.10 to 1.30 inches.

6. The driver-type golf club head of claim 1, wherein the club head body comprises a crown apex point located at a highest point on the crown in the YZ plane, the crown apex point comprises a height between about 2.15 inches and 2.45 inches measured between the crown apex point and the ground plane parallel to the y-axis.

7. The driver-type golf club head of claim 6, wherein the crown apex point comprises a crown apex point depth measured between the top edge point and the crown apex point parallel to the z-axis, and the crown apex point depth is between about 0.70 and 0.90 inch.

8. The driver-type golf club head of claim 7, wherein the club head comprises a crown apex angle measured between a first imaginary line parallel to the z-axis and a second imaginary line which intersects both the crown apex point and the top edge point, and the crown apex angle ranges between 18 degrees and 23 degrees.

9. The driver-type golf club head of claim 8, wherein the club head body comprises a sole apex point located at a lowest point on the sole in the YZ plane;

the sole apex point comprises a sole apex point depth measured from the bottom edge point to the sole apex point and parallel to the z-axis, and the sole apex point depth ranges from 0.60 to 0.67 inch.

10. The driver-type golf club head of claim 9, wherein the club head body comprises a sole apex angle measured between a third imaginary line parallel to the z-axis and a fourth imaginary line which intersects both the sole apex point and the bottom edge point, and the sole apex angle ranges between 27 degrees and 32 degrees.

11. A driver-type golf club head comprising:

a club head body comprising:

a crown, a front end, a rear end opposite the front end, a toe end, a heel end opposite the toe end, a sole opposite the crown, and a skirt forming a transition surface between the crown and the sole other than on the front end, each having an inner and outer surface, and a strike face located on the front end comprising a geometric center;

a body width, a body depth, and a body height; and a body center of gravity;

a face insert and a front opening configured to receive the face insert;

wherein:

a loft plane is defined tangent to the geometric center;

a ground plane is defined tangent to the sole when the club head body is in an address position;

a loft angle is defined by the loft plane and the ground plane;

wherein the loft angle is in a range of 7.0 degrees to 16 degrees;

an x-axis is defined through the geometric center in a toe portion to heel portion direction parallel to the ground plane;

a y-axis is defined through the geometric center in a crown to sole direction perpendicular to the x-axis;

a z-axis is defined through the geometric in a front end to rear end direction perpendicular to both the x-axis and to the y-axis;

a y'-axis is defined through the center of gravity in a crown to sole direction parallel to the y-axis;

an Iyy is measured as the moment of inertia about the y'-axis, and the Iyy ranges from about 4900 $g*cm^2$ to 5900 $g*cm^2$;

the body width is measured between a heelward-most point and a toeward-most point parallel to the x-axis, and the body width is between 4.6 inches and 5 inches;

the body depth is measured between a leading edge and a rearward-most point parallel to the z-axis, and the body depth is between 4.5 and 4.95 inches;

the body height is measured between the ground plane and a highest point on the crown; and the body height is between about 2.3 and 2.8 inches;

a volume of the club head body is greater than about 440 $cm^3$;

a $Y_{GP}$ is measured from the body center of gravity to the ground plane, parallel to the y-axis, and the $Y_{GP}$ is between about 0.8 inch and 1.0 inch;

a CGz is measured from the geometric center to the body center of gravity, parallel to the z-axis, the CGz is between about 1.60 and 1.85 inches;

the face insert comprises a face insert perimeter, a face insert front surface which forms at least a portion of the strike face, and a face insert rear surface;

the face insert perimeter comprises a top edge and a bottom edge;

the face insert comprises a top edge point defined by the intersection of the top edge of the face insert perimeter and the YZ plane;

the face insert perimeter comprises a bottom edge point defined by the intersection of the bottom edge of the face insert perimeter and the YZ plane;

the face insert perimeter comprises a face insert perimeter length between 7.30 inches and 8.10 inches;

the face insert comprises a face insert height, measured between the top edge point and the bottom edge point parallel to the loft plane, and the face insert height is between about 1.35 inches and 1.70 inches;

the face insert comprises a face insert volume, measured as the volume bounded by the face insert front surface, the face insert rear surface, and the face insert perimeter projected perpendicular to the loft plane, and the face insert volume is between about 0.244 $in^3$ and 0.400 $in^3$;

the face insert comprises a face insert area, measured as the area of the face insert front surface bounded by the face insert perimeter, and the face insert area is between about 3.0 $in^2$ and 4.30 $in^2$; and the face insert comprises a face insert thickness measured as the face insert volume divided by the face insert front area, the face insert thickness is between about 0.085 and 0.110 inch.

12. The golf club head of claim 11, wherein the face insert height is between about 1.45 inches and 1.52 inches.

13. The golf club head of claim 12, wherein the face insert thickness is between about 0.094 inch and 0.098 inch.

14. The golf club head of claim 13, wherein the face insert comprises a mass ranging from about 22 to 28 grams.

15. The golf club head of claim 11, wherein the face insert area is less than a strike face area, the strike face area is defined by a bulge and roll curvature profile.

16. The golf club head of claim 15, wherein the club head comprises a removably attached weight;

the removably attached weight comprises a mass ranging from 18 to 38 grams.

17. The golf club head of claim 16, wherein the face insert is welded to the front opening.

18. The golf club head of claim 11, wherein the face insert comprises a VFT profile on the face insert rear surface.

19. The golf club head of claim 18, wherein the face insert is made from a material having a density between 50 $g/in^3$ to 100 $g/in^3$.

20. The golf club head of claim 19, wherein a thickness at the geometric center is less than 0.125 inch.

* * * * *